US009360838B2

(12) United States Patent
Miyagawa et al.

(10) Patent No.: US 9,360,838 B2
(45) Date of Patent: Jun. 7, 2016

(54) COOLING DEVICE AND IMAGE FORMING APPARATUS INCORPORATING SAME

(71) Applicants: Hiroaki Miyagawa, Ibaraki (JP); Satoshi Aizawa, Ibaraki (JP); Susumu Tateyama, Ibaraki (JP); Tomoyasu Hirasawa, Kanagawa (JP)

(72) Inventors: Hiroaki Miyagawa, Ibaraki (JP); Satoshi Aizawa, Ibaraki (JP); Susumu Tateyama, Ibaraki (JP); Tomoyasu Hirasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/321,908

(22) Filed: Jul. 2, 2014

(65) Prior Publication Data

US 2015/0010338 A1 Jan. 8, 2015

(30) Foreign Application Priority Data

Jul. 8, 2013 (JP) ..... 2013-143100
May 8, 2014 (JP) ..... 2014-096507

(51) Int. Cl.
*G03G 15/20* (2006.01)
*G03G 21/20* (2006.01)

(52) U.S. Cl.
CPC ..... *G03G 21/206* (2013.01); *G03G 15/2021* (2013.01); *G03G 21/20* (2013.01)

(58) Field of Classification Search
CPC ..... G03G 21/206; G03G 15/2021
USPC ..... 399/45, 341
See application file for complete search history.

(56) References Cited

U.S. PATENT DOCUMENTS

| | | | |
|---|---|---|---|
| 2010/0008695 | A1 | 1/2010 | Okano et al. |
| 2011/0030927 | A1 | 2/2011 | Okano et al. |
| 2011/0052247 | A1 | 3/2011 | Saitoh et al. |
| 2011/0052248 | A1 | 3/2011 | Nishimura et al. |
| 2011/0170895 | A1 | 7/2011 | Fujiya et al. |
| 2012/0061057 | A1 | 3/2012 | Okano et al. |
| 2012/0070180 | A1 | 3/2012 | Iijima et al. |
| 2012/0227927 | A1 | 9/2012 | Fujiya et al. |
| 2012/0263491 | A1 | 10/2012 | Fujiya et al. |
| 2012/0315069 | A1 | 12/2012 | Ikeda et al. |
| 2013/0259512 | A1 | 10/2013 | Ikeda et al. |
| 2014/0044462 | A1 | 2/2014 | Ikeda et al. |
| 2014/0060782 | A1 | 3/2014 | Ikeda et al. |

FOREIGN PATENT DOCUMENTS

| | | |
|---|---|---|
| EP | 2 444 859 A2 | 4/2012 |
| JP | 2010-266810 | 11/2010 |

OTHER PUBLICATIONS

English machine translation of JP 2010-266810 A.*
Extended European Search Report issued on Dec. 2, 2014 in Patent Application No. 14176119.7.
U.S. Appl. No. 14/140,854, filed Dec. 26, 2013.
U.S. Appl. No. 14/140,888, filed Dec. 26, 2013.
(Continued)

*Primary Examiner* — Walter L Lindsay, Jr
*Assistant Examiner* — Ruth Labombard
(74) *Attorney, Agent, or Firm* — Oblon, McClelland, Maier & Neustadt, L.L.P

(57) ABSTRACT

A liquid type cooling device, which is incorporated in an image forming apparatus, includes a heat releasing unit to release heat of a coolant that passes therethrough, and multiple air blowing fans disposed facing the heat releasing unit to blow air to the heat releasing unit. A cooling capacity of the liquid type cooling device varies according to a type of a recording medium on which an image is formed.

23 Claims, 14 Drawing Sheets

(56) References Cited

OTHER PUBLICATIONS

U.S. Appl. No. 14/182,734, filed Feb. 18, 2014.
U.S. Appl. No. 14/276,067, filed May 13, 2014.
U.S. Appl. No. 14/248,652, filed Apr. 9, 2014.
U.S. Appl. No. 14/260,562, filed Apr. 24, 2014.

* cited by examiner

COOLING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2013-143100, filed on Jul. 8, 2013, and 2014-096507, filed on May 8, 2014 in the Japan Patent Office, the entire disclosures of which are hereby incorporated by reference herein.

BACKGROUND

1. Technical Field

Embodiments of the present invention relate to a cooling device and an image forming apparatus incorporating the cooling device.

2. Related Art

Known image forming apparatuses serve as printers, facsimile machines, copiers, and multifunctional apparatuses having two or more functions of the printers, facsimile machines, and copiers. In these image forming apparatuses, as an image forming operation proceeds, temperatures of components disposed in each process unit such as a fixing unit and a development unit provided in the image forming apparatus and temperatures of recording media such as paper sheets on which an image is formed increase.

In order to prevent the inconvenience due to an increase in temperature of any components and/or recording media beyond a permissible temperature value, it has been known that an image forming apparatus includes a cooling device to cool the heated components and/or recording media therein.

Known cooling devices have two cooling types, which are an air type cooling device and a liquid type cooling device. The air type cooling device cools a cooling target by blowing cool air. The liquid type cooling device cools a cooling target by conveying heat absorbed by a heat receiver disposed in contact with the cooling target and releases the heat via a heat releasing part. Generally, the liquid type cooling device can achieve a higher cooling effectiveness than the air type cooling device.

The following liquid type cooling device is known as an example of a cooling device to cool components provided in each process unit.

Developer that includes toner (e.g., one-component developer) or toner and carrier particles (e.g., two-component developer) contained in the development unit is susceptible to frictional heat generated when the developer is agitated and conveyed in the development unit or fixing heat generated in the fixing unit of the image forming apparatus. Due to the frictional heat and/or the fixing heat, the temperature of the toner increases to cause a toner cohesion. The toner cohesion can lead to production of a defect image.

In order to prevent such a toner cohesion, the liquid type cooling device includes a heat receiver to absorb heat of the developer indirectly from a sidewall of a developer container in which the developer is contained. By so doing, the temperature of the developer is maintained within a given range.

The following liquid type cooling device is known as a cooling device to cool recording media.

After application of heat and pressure to a recording medium in the fixing device, the recording medium is conveyed to a sheet discharging tray. As the recording medium stacks with other recording medium or media in the sheet discharging tray, the toner particle softens due to heat in the stacked recording media. Further, since the recording media are piled or stacked with each other in the sheet discharging tray, a pressure is generated due to a weight of the recording media. Accordingly, the toner can stick two adjacent recording media together. In this case, if the recording media are detached forcibly from each other, the toner image formed on both or either one of the adjacent recording media can be damaged or broken. This inconvenience is referred to as toner blocking.

In order to reduce or prevent occurrence of toner blocking, after the toner image is fixed to the recording medium or media by application of heat and pressure, the heat receiver absorbs heat from the recording media directly or indirectly to cool the recording medium or media.

For example, Japanese Patent Application Publication No. JP 2010-266810-A discloses a liquid type cooling device to cool a recording medium after the recording medium is heated to fix a toner image thereto in the fixing unit. The liquid type cooling device disclosed in JP 2010-266810-A includes a cooling roller, a radiator, and an air blowing fan. The cooling roller functions as a heat receiver to absorb heat from the recording media. The radiator functions as a heat releasing unit to release the heat absorbed by the cooling roller. The air blowing fan functions as an air blower to blow air (or wind) to the radiator for enhancing a heat releasing effect of the radiator.

In the liquid type cooling device disclosed in JP 2010-266810-A, a rotation speed of the air blowing fan is adjusted according to a type of recording media to be cooled after the toner image is fixed thereto by application of heat and pressure in the fixing unit. Accordingly, a cooling capacity of the cooling roller to cool the recording media varies.

Demands to increase types of recording media to be used for image formation in an image forming apparatus have been growing.

Typical fixing units include a fixing member such as a fixing roller and a pressure member such as a pressure roller. In such typical fixing units, the fixing member forms a fixing nip contact area together with the pressure member, and is controlled to have a substantially constant temperature when the recording medium is fixed in the fixing unit by application of heat and pressure. Therefore, when a subsequent recording medium having a paper type different from the preceding recording medium passes through the fixing nip contact area, a heat capacity and conductivity of the subsequent recording medium change from the preceding recording medium. Therefore, a required heat amount for the subsequent recording medium changes, and the temperature of a heat member such as a heater to heat the fixing member varies to maintain the substantially constant temperature of the fixing member. Accordingly, when the temperature of the heating member varies, not only the heat amount for the subsequent recording medium but also the heat amount to be released from the fixing unit into an apparatus body of the image forming apparatus changes.

Therefore, in order to encourage energy efficiency, it is preferable that the cooling device incorporated in the image forming apparatus for various types of recording media having different heat amounts for image fixing by application of heat and pressure.

The liquid type cooling device disclosed in JP 2010-266810-A can cool a recording medium according to the type of the recording medium, and therefore can vary the cooling capacity accordingly.

However, due to the following reasons, installation space for the radiator and air blowing fan(s) cannot be more flexible, and therefore it is not likely to decrease a size of the image forming apparatus and to achieve better cooling efficiency for a cooling target.

A fan casing of typical air blowing fans used in the image forming apparatus has a substantially square shape in vertical cross section in a rotation shaft of fans of the air blowing fan, that is, in an air blowing direction of the air blowing fan. Due to cost performance and versatility, many typical radiators have a rectangular shape in vertical cross section in a direction that air generated by the air blowing fan hits and passes through the radiators.

The liquid type cooling device disclosed in JP 2010-266810-A has one air blowing fan to be rotated with respect to one radiator. Even though not shown in JP 2010-266810-A in detail, from FIGS. 3 and 5 of JP 2010-266810-A, the shapes of the radiator and the air blowing fan may have similar shapes to the above-described typical radiators and the air blowing fans having the substantially square shapes in vertical cross section in the air blowing direction of the air blowing fan.

For these reasons, even if vacant space in the image forming apparatus has a rectangular shape in vertical cross section in the air blowing direction of the air blowing fan and can obtain a desired heat releasing effect when air hits the radiator at a given speed, the installation space has no other choice to have a substantially square shape for the radiator and the air blowing fan. Therefore, the entire area of the rectangular shape in vertical cross section of the vacant space in the image forming apparatus cannot be utilized effectively.

SUMMARY

At least one embodiment of the present invention provides a cooling device including a heat releasing unit to release heat of a coolant that passes therethrough, and multiple air blowing fans disposed facing the heat releasing unit to blow air to the heat releasing unit. A cooling capacity of the liquid type cooling device varies according to a type of a recording medium on which an image is formed.

Further, at least one embodiment of the present invention provides an image forming apparatus including a fixing unit to fix the image formed on the recording medium to the recording medium by application of heat and the above-described cooling device to cool the recording medium.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
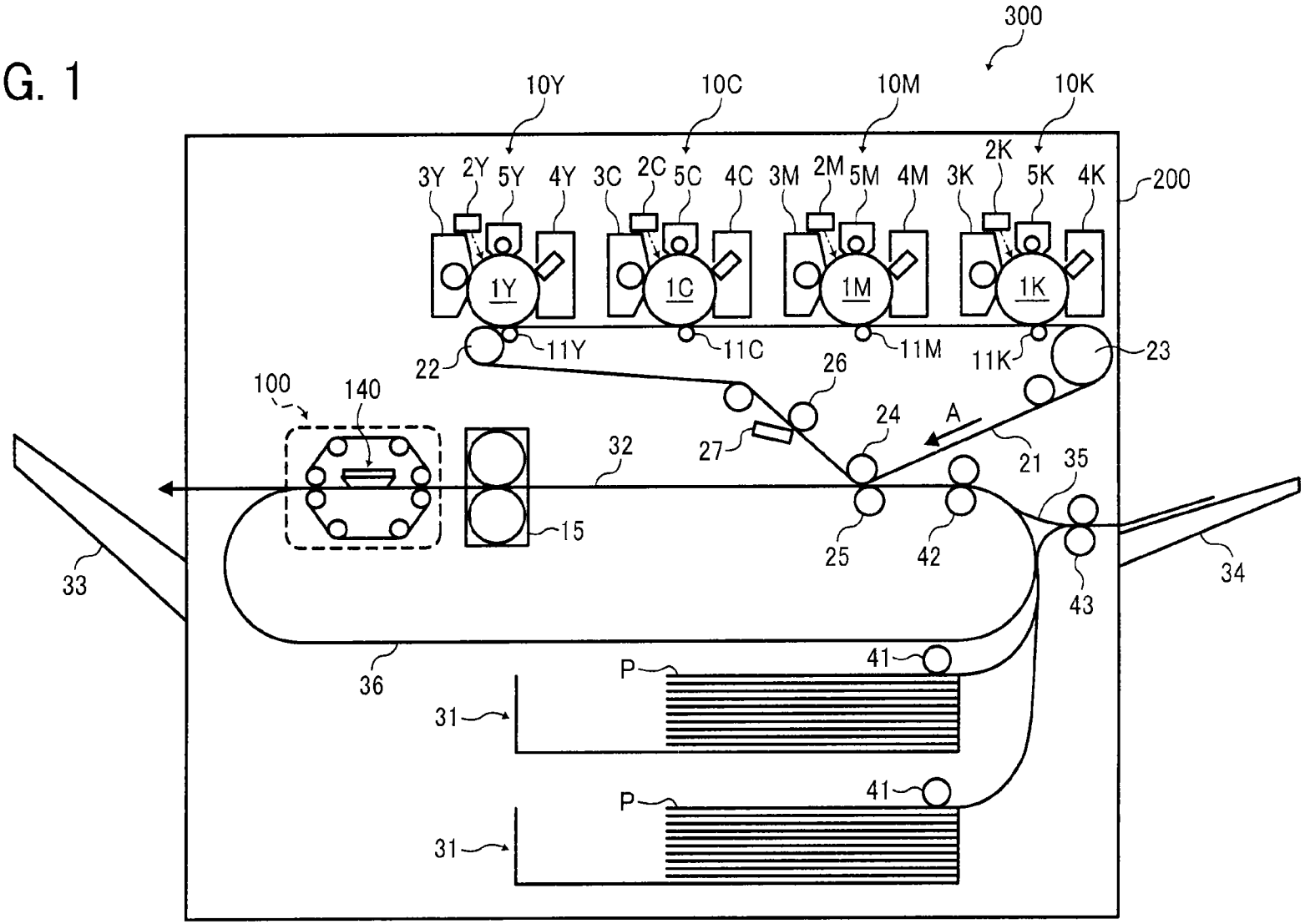
FIG. 1 is a diagram illustrating a configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an image forming apparatus 300 according to an embodiment of the present invention, with reference to FIG. 1.

FIG. 1 is a diagram illustrating a schematic configuration of the image forming apparatus 300 according to an embodiment.

The image forming apparatus 300 may be a copier, a facsimile machine, a printer, a plotter, a multifunction peripheral or a multifunction printer (MFP) having at least one of copying, printing, scanning, facsimile, and plotter functions, or the like. According to the present embodiment, the image forming apparatus 300 is an electrophotographic printer, that forms color and monochrome toner images on a sheet or sheets by electrophotography.

Further, it is to be noted in the following embodiments that the term "sheet" is not limited to indicate a paper material but also includes OHP (overhead projector) transparencies, OHP film sheets, coated paper, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

As illustrated in FIG. 1, the image forming apparatus 300 according to an embodiment includes an apparatus body 200 having multiple rollers (i.e., a first tension roller 22, a second tension roller 23, a third tension roller 24 and so forth), an intermediate transfer belt 21, and image forming process units.

The intermediate transfer belt 21 functions as an intermediate transfer body. The intermediate transfer belt 21 is wound about the multiple rollers with tension. As one of the multiple rollers is driven, the intermediate transfer belt 21 rotates in a direction indicated by arrow A in FIG. 1.

The image forming process units are disposed around the intermediate transfer belt 21. Suffixes, which are Y, M, C, and K, are used to indicate respective colors of toners (e.g., yellow, cyan, magenta, and black toners) for the process units.

Serving as the image forming process units, four image forming stations 10Y, 10C, 10M, and 10K are disposed above the intermediate transfer belt 21 and between the first tension roller 22 and the second tension roller 23. Specifically, the image forming station 10Y for yellow (Y) images, the image forming station 10C for cyan (C) images, the image forming station 10M for magenta (M) images, and the image forming station 10K for black (K) images are disposed in this order from an upstream side of a surface moving direction of the intermediate transfer belt 21 in the direction A.

It is to be noted that FIG. 1 illustrates four image forming stations 10Y, 10C, 10M, and 10K having the identical configuration and functions to each other except toner colors, which are yellow (Y), magenta (M), cyan (C), and black (K). Each image forming station 10 includes a photoconductor 1 (i.e., photoconductors 1Y, 1C, 1M, and 1K) and an image forming components disposed around the photoconductor 1. Specifically, the image forming components are a charger 5 (i.e., chargers 5Y, 5C, 5M, and 5K), an optical writing unit 2 (i.e., optical writing units 2Y, 2C, 2M, and 2K), a development unit 3 (i.e., development units 3Y, 3C, 3M, and 3K), and a photoconductor cleaning unit 4 (i.e., photoconductor cleaning units 4Y, 4C, 4M, and 4K).

The image forming apparatus 300 further includes primary transfer rollers 11Y, 11C, 11M, and 11K. Hereinafter, the primary transfer rollers 11Y, 11C, 11M, and 11K are also referred to in a singular form, the primary transfer roller 11. The primary transfer roller 11 functions as a primary transfer unit to transfer a toner image onto a surface of the intermediate transfer belt 21. The primary transfer rollers 11Y, 11C, 11M, and 11K are disposed facing the photoconductors 1Y, 1C, 1M, and 1K, respectively, with the intermediate transfer belt 21 interposed therebetween. The image forming stations 10Y, 10C, 10M, and 10K are aligned along the surface moving direction of the intermediate transfer belt 21 at given pitch intervals to each other.

The optical writing unit 2 provided in the image forming apparatus 300 has an LED (light emitting diode) light source. However, the optical writing unit 2 can alternatively have a semiconductor laser light source to expose the photoconductor 1 according to image data.

The image forming apparatus 300 further includes the following units and components for forming toner images.

Two sheet trays 31, two sheet feed rollers 41, and a registration roller pair 42 are disposed below the intermediate transfer belt 21. Each of the sheet trays 31 accommodates a stack of sheets P including a sheet P that functions as a recording medium. The sheet trays 31, the sheet feed rollers 41, and the registration roller pair 42 constitute a sheet feeding part.

A secondary transfer roller 25 is disposed facing the third tension roller 24, which is one of the multiple rollers around which the intermediate transfer belt 21 is wound, with the intermediate transfer belt 21 interposed therebetween. The secondary transfer roller 25 that functions as a secondary transfer unit to transfer the toner image from the intermediate transfer belt 21 to the sheet P.

A cleaning opposed roller 26 is disposed in contact with a back surface or an inner circumferential surface of the intermediate transfer belt 21.

A belt cleaning unit 27 is disposed in contact with an outer circumferential surface (a front side) of the intermediate transfer belt 21 at a position where the cleaning opposed roller 26 contacts the intermediate transfer belt 21. The belt cleaning unit 27 cleans the outer circumferential surface (the front side) of the intermediate transfer belt 21.

A bypass path 35, a bypass sheet feed roller 43, and a bypass tray 34 are provided on a right side of the registration roller pair 42 in FIG. 1 to be used for bypass sheet feeding.

A sheet conveying path 32 is arranged between the intermediate transfer belt 21 and the sheet trays 31 and extends from the sheet feeding part to a sheet discharging tray 33.

A fixing unit 15 is disposed downstream from the secondary transfer roller 25 via the sheet conveying path 32 in a sheet conveying direction. The fixing unit 15 includes a heat roller and a pressure roller. The pressure roller of the fixing unit 15 has a heater therein. The heater functions as a heat source to fix the toner image to the sheet P by application of heat and pressure.

A cooling device 100 is disposed downstream from the fixing unit 15 in the sheet conveying path 32 in the sheet conveying direction. The cooling device 100 cools the sheet P after completion of a fixing operation in the fixing unit 15.

The sheet discharging tray 33 is disposed at an outside of the apparatus body 200 and downstream from the cooling device 100 in the sheet conveying direction. The sheet discharging tray 33 functions as a sheet discharging unit to which the sheet P is discharged after the toner image is fixed to the sheet P by heat and pressure.

A reverse path 36 is also provided in the image forming apparatus 300 for forming a toner image on a back surface of the sheet P for a duplex printing operation. During the duplex printing operation, the sheet P that has once passed the cooling device 100 is reversed and conveyed to the registration roller pair 42 through the reverse path 36.

The two sheet trays 31 in the sheet feeding part may contain the sheets P of either the same type or different types. When the type of the sheets P in each of the sheet trays 31 of the image forming apparatus 300 has changed, a user updates sheet information via a control panel 220 (refer to FIG. 15) provided to the apparatus body 200 by inputting a type (e.g., a paper type and size, etc.) of the sheets P that has newly accommodated in the sheet tray(s) 31. The sheet information is stored in a memory provided in an apparatus controller 210 (refer to FIG. 15) for setting the units of each process unit for image formation and for setting the cooling device 100, details of which are described below.

A description is given of a series of image forming processes in the image forming apparatus 300.

The image forming station 10 employs a typical electrostatic printing process to form an electrostatic latent image by the optical writing unit 2 on the photoconductor 1 that is uniformly charged by the charger 5 in a dark location. The electrostatic latent image on the photoconductor 1 is developed by the development unit 3 to a visible toner image. The toner image is transferred from the photoconductor 1 onto the intermediate transfer belt 21 by the primary transfer roller 11. After this primary transfer operation, the surface of the photoconductor 1 is cleaned by the photoconductor cleaning unit 4.

The above-described series of the image forming process is performed in the image forming stations 10Y, 10C, 10M, and 10K.

The development units 3Y, 3C, 3M, and 3K perform a development operation of the image forming process with different toner colors. Therefore, the image forming stations 10Y, 10C, 10M, and 10K are assigned with respective single color formation of yellow, cyan, magenta, and black to form a full-color toner image.

As described above, the primary transfer rollers 11Y, 11C, 11M, and 11K are disposed facing the photoconductors 1Y, 1C, 1M, and 1K, respectively, with the intermediate transfer belt 21 interposed therebetween in the image forming stations 10Y, 10C, 10M, and 10K, respectively. Respective transfer biases are applied to the primary transfer rollers 11Y, 11C, 11M, and 11K. The primary transfer rollers 11Y, 11C, 11M, and 11K constitute a primary transfer part.

According to the above-described configuration, an identical image forming area on the intermediate transfer belt 21 passes the image forming stations 10Y, 10C, 10M, and 10K sequentially, during which respective single color toner images are overlaid one by one on the intermediate transfer belt 21 with the respective transfer biases applied to the primary transfer rollers 11Y, 11C, 11M, and 11K. Consequently, at completion of one cycle of the identical image forming area passing the primary transfer part of the image forming stations 10Y, 10C, 10M, and 10K, the full-color toner image is formed in the identical image forming area by overlaying the respective single color toner images.

With the above-described operations, the full-color toner image formed on the intermediate transfer belt 21 is transferred onto the sheet P that is conveyed from the selected one of the sheet trays 31 and the bypass tray 34. After the primary transfer operation, the intermediate transfer belt 21 is cleaned by the belt cleaning unit 27.

The toner image from the intermediate transfer belt 21 is transferred onto the sheet P in a secondary transfer operation. In the secondary transfer operation, a secondary transfer bias is applied to the secondary transfer roller 25 to generate a transfer electric field between the secondary transfer roller 25 and the third tension roller 24 via the intermediate transfer belt 21. When the sheet P passes a nip contact area formed between the secondary transfer roller 25 and the intermediate transfer belt 21, the full-color toner image formed on the intermediate transfer belt 21 is transferred onto the sheet P.

It is to be noted that the sheet P fed from the selected one of the sheet trays 31 and the bypass tray 34 is conveyed by the registration roller pair 42 disposed upstream from a transfer nip contact area in the sheet conveying direction, in synchronization with movement of the toner image formed on the intermediate transfer belt 21 to the transfer nip contact area.

After transfer of the full-color toner image from the intermediate transfer belt 21 onto the sheet P, the full-color toner image on the sheet P is fixed to the sheet P by application of heat and pressure in the fixing unit 15. By so doing, the toner image is fixed to the sheet P by heat fixing, and then a final full-color image is formed on the sheet P. Thereafter, the sheet P is cooled by the cooling device 100 that has a belt conveying unit and a cooling body 141 and is discharged to the sheet discharging tray 33. The belt conveying unit includes a front-side holding part 160 and a reverse-side holding part 170 and conveys the sheet P while sandwiching the sheet P between two conveying belts (i.e., the front-side holding part 160 and the reverse-side holding part 170). The cooling body 141 functions as a heat receiving body disposed on the inner circumferential surface of a selected one of the two conveying belts. Therefore, when the sheet P is discharged onto the sheet discharging tray 33, toner on the sheet P can be hardened reliably, thereby preventing toner blocking.

It is to be noted that, by connecting an optional scanner unit and a facsimile unit, the image forming apparatus 300 according to an embodiment can serve as a multifunctional image forming apparatus having functions of a copier and a facsimile machine. Further, in addition to the sheet trays 31 of the apparatus body 200, a sheet feed table that functions as a sheet feeding part having multiple sheet trays can be connected to a position below the apparatus body 200 or a position where the bypass tray 34 is disposed.

In the present embodiment, the cooling device 100 is described to cool the sheet P after the heat fixing in the fixing unit 15. However, the configuration of the cooling device 100 is not limited thereto.

For example, the present invention can be applied to a cooling device having a configuration to prevent cohesion of developer particles including toner particles or toner and carrier particles or adhesion of the developer particles to an agitation screw caused by frictional heat of the developer particles with the agitation screw in the development unit 3. Further, the temperature in the image forming apparatus 300 can increase to exceed a permissible temperature due to friction heat of the above-described developer particles, heating of motors used in the process units (i.e., the image forming stations 10Y, 10C, 10M, and 10K), and heating of a heater provided in the fixing unit 15. In order to prevent the increase in temperature in the image forming apparatus 300, the present invention is also applicable to a cooling device to cool an optional heater or optional heaters.

Next, a description is given of the cooling device 100 included in the image forming apparatus 300 according to an embodiment to cool the sheet P after having the heat fixing in the fixing unit 15.

Unless otherwise noted, the terms in an embodiment or embodiments of the present invention are written based on the following descriptions. Regarding the sheet P with the toner image fixed thereto by application of heat and pressure in the fixing unit 15, one side where softened toner is attached to is referred to as a "front side of the sheet P" and an opposite side to the front side is referred to as a "reverse side of the sheet P". Regarding relative directions of units and components included in the image forming apparatus 300 and the cooling device 100, in reference to FIG. 1, an upstream side of the sheet conveying path 32 that runs substantially horizontally in the image forming apparatus 300 in the sheet conveying direction is referred to as an "upstream side of the image forming apparatus 300 or the cooling device 100" or a "right side of the image forming apparatus 300 or the cooling device 100", a downstream side of the sheet conveying path 32 in the sheet conveying direction is referred to as a "downstream side of the image forming apparatus 300 or the cooling device 100" or a "left side of the image forming apparatus 300 or the cooling device 100", an upper side toward the top in the drawing of FIG. 1 is referred to as a "front side of the image forming apparatus 300 or the cooling device 100", and a lower side toward the top in the drawing of FIG. 1 is referred to as a "back of the image forming apparatus 300 or the cooling device 100".

Further, unless otherwise specified, the cooling device 100 according to an embodiment and a comparative cooling device described below share identical terms of units and components having common functions.

A description is given of an exemplary configuration of the cooling device 100 according to an embodiment of the present invention.

Figure 2:
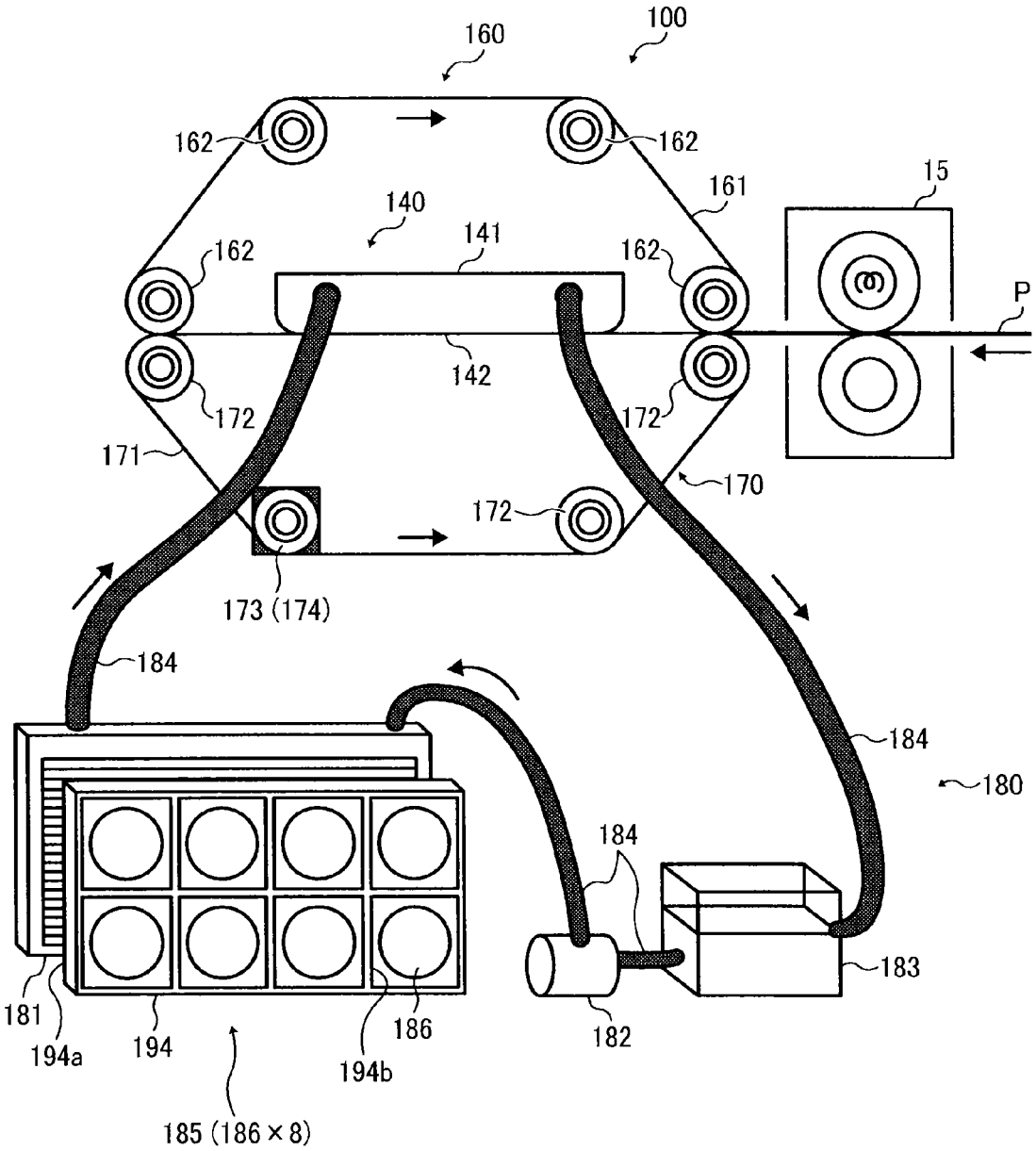
FIG. 2 is a diagram illustrating a cooling device included in the image forming apparatus of FIG. 1.
Figure 3:
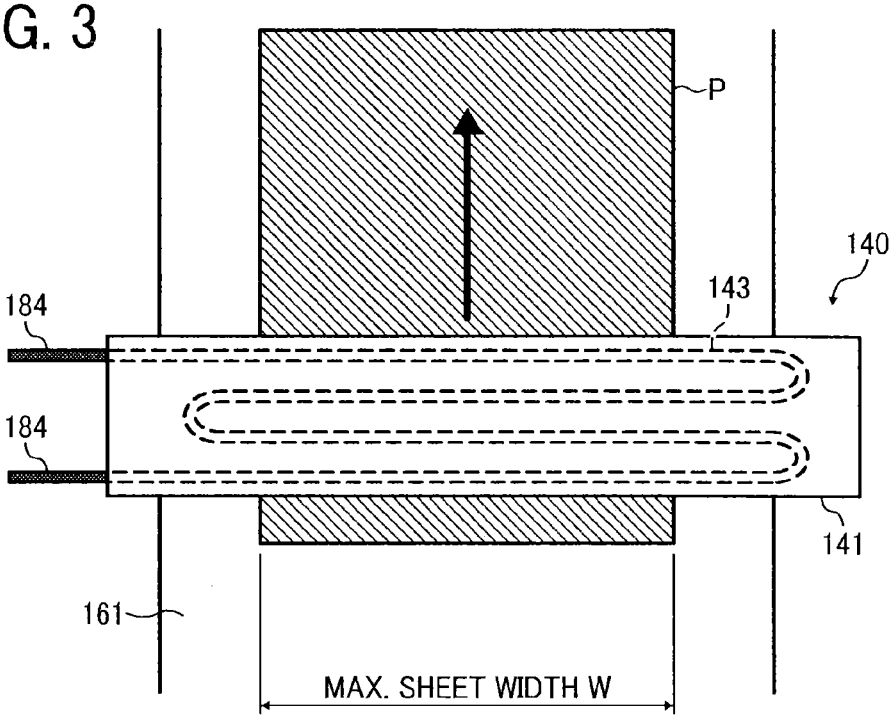
FIG. 3 is a diagram illustrating a cooling body included in the cooling device of FIG. 2.
Figure 4:
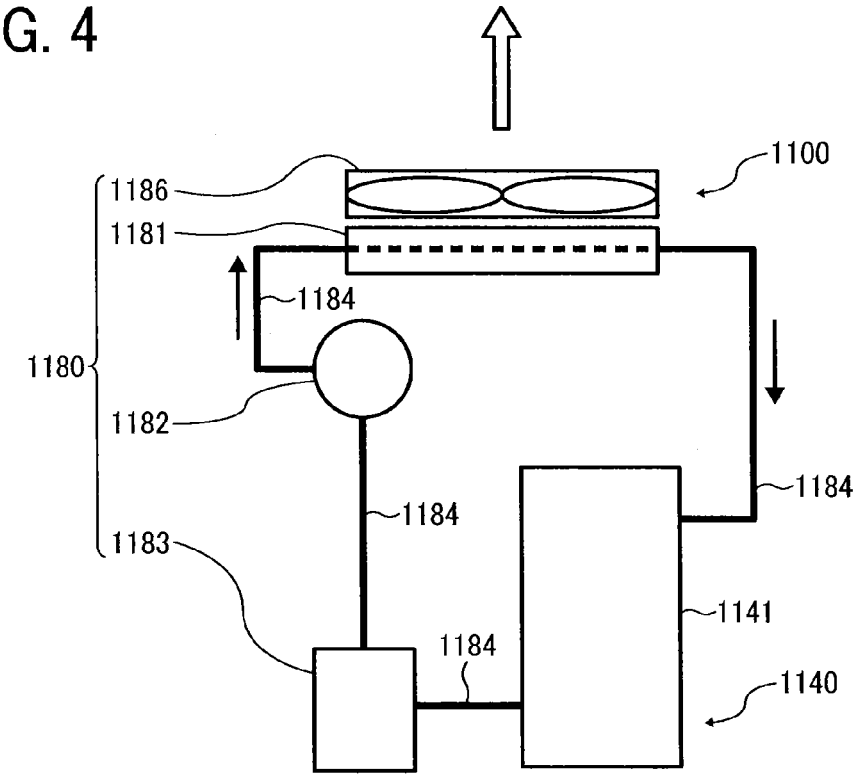
FIG. 4 is a diagram illustrating a configuration of a comparative cooling device as a comparative example.
Figure 5A:
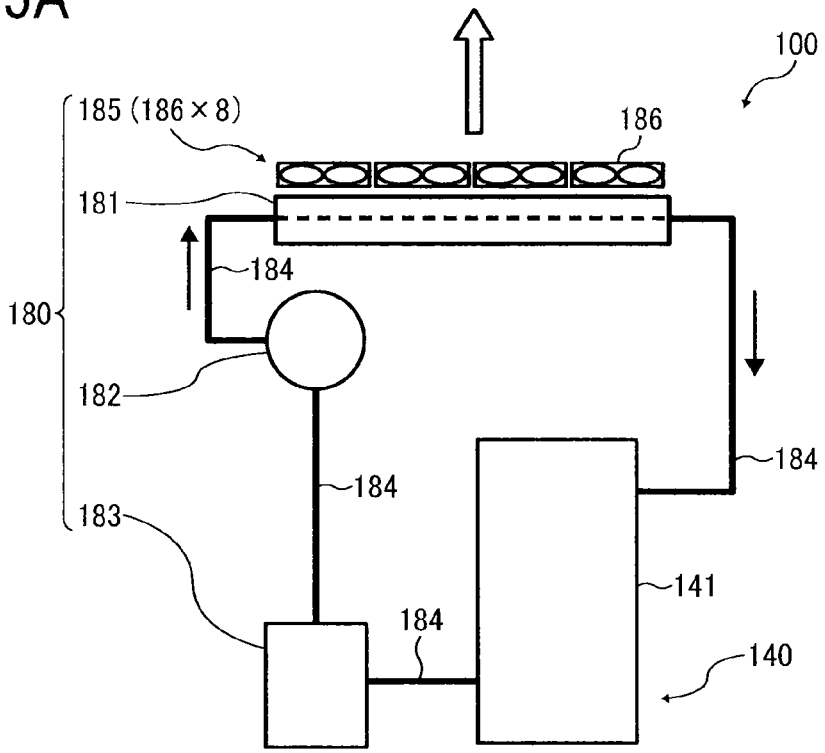
FIG. 5A is a plan view illustrating the cooling device according to an embodiment.
Figure 5B:
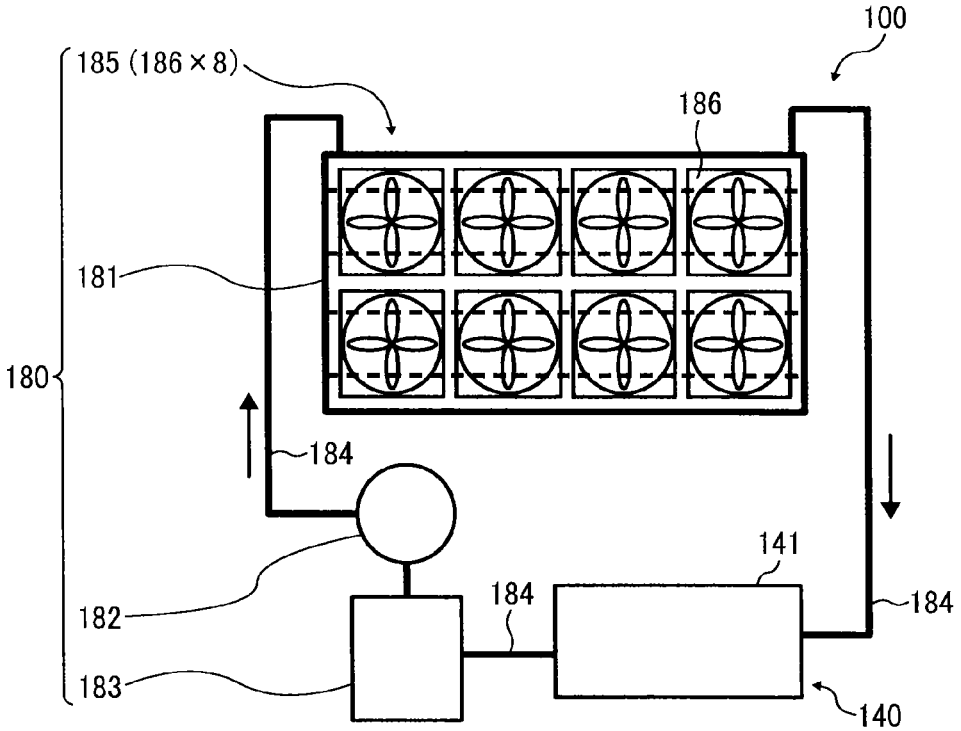
FIG. 5B is an elevation illustrating the cooling device according to an embodiment.

FIG. 2 is a diagram illustrating the cooling device 100 included in the image forming apparatus 300 according to an embodiment. FIG. 3 is a diagram illustrating a cooling body 141 included in the cooling device 100 of FIG. 2. FIG. 4 is a diagram illustrating a configuration of the comparative cooling device as a comparative example. FIG. 5A is a plan view illustrating the cooling device 100. FIG. 5B is an elevation illustrating the cooling device 100.

The cooling device 100 includes the front-side holding part 160 and the reverse-side holding part 170, both of which function as holding parts to hold and convey the sheet P after the toner image fixed thereto by application of heat and pressure in the fixing unit 15, as illustrated in FIG. 2. Specifically, the front-side holding part 160 holds the sheet P having softened toner thereon from the front side of the sheet P and the reverse-side holding part 170 holds the sheet P from the reverse side of the sheet P.

The cooling device 100 further includes a heat radiating part 180 that is a liquid type radiating part to release heat absorbed from the sheet P into the air. The front-side holding part 160 includes a heat receiver 140 (refer to FIGS. 1 and 2) having a metallic (or aluminum) cooling body 141 and a front-side conveying belt 161. The heat radiating part 180 releases the heat from the sheet P into the air via the cooling body 141 that contacts the sheet P with the front-side conveying belt 161 interposed therebetween.

Specifically, the front-side holding part 160 includes four front-side driven rollers 162, the front-side conveying belt 161, and the cooling body 141. The front-side driven rollers 162 are disposed on an upper side of the sheet conveying path 32 in FIG. 1, so as to wind the front-side conveying belt 161 therearound in a trapezoidal shape.

By contrast, the reverse-side holding part 170 includes three reverse-side driven rollers 172, a drive roller 173, and a reverse-side conveying belt 171. The reverse-side driven rollers 172 and the drive roller 173 are disposed on a lower side of the sheet conveying path 32 in FIG. 1, so as to wind the reverse-side conveying belt 171 therearound in an inverted trapezoidal shape. The drive roller 173 functions as a conveying drive part to drive under control of a cooling device controller 110 (refer to FIG. 15) that controls the cooling device 100. The drive roller 173 is connected to a drive motor 174 that functions as a drive source dedicated to the drive roller 173 or shared with other drive units and/or components.

It is to be noted that the cooling device controller 110 of the cooling device 100 according to the present embodiment obtains information from the apparatus controller 210 (refer to FIG. 15) regarding a timing of passage of the sheet P, the type of the sheet P, and so forth, and controls driving of the drive motor 174 that drives the drive roller 173, a coolant feed pump 182, and multiple air blowing fans 186 contained in a fan unit 185.

The heat radiating part 180 includes a radiator 181, the coolant feed pump 182, a reservoir tank 183, and rubber tubes 184. The radiator 181 functions as a heat releasing unit. The coolant feed pump 182 feeds and flows liquid coolant. The reservoir tank 183 reserves the liquid coolant therein. The rubber tubes 184 are tubular members that function as outer coolant conduits to let the liquid coolant flow between an outlet of an upstream unit and an inlet of a downstream unit arranged in a coolant conveying direction, and that function as circulating paths to circulate the coolant connecting the radiator 181, the coolant feed pump 182, the reservoir tank 183, and the cooling body 141 of the heat receiver 140. With this configuration, the liquid coolant that circulates through the circulating paths functions as a heat transporter to transport heat of the sheet P absorbed from a cooling surface 142 of the cooling body 141 via the front-side conveying belt 161 to the radiator 181 that has inner flow paths 181*a* (refer to FIG. 11A) through which the liquid coolant flows. The liquid coolant used in the present embodiment is propylene glycol solution that is known as anti-freeze solution.

The heat radiating part 180 further includes the fan unit 185. The fan unit 185 that functions an air blowing unit that blows air toward the radiator 181 to release the heat of the liquid coolant that passes through the inner flow paths 181*a* to an outside of the radiator 181, that is, to enhance cooling capacity (cooling effectiveness) of the cooling device 100.

The fan unit 185 includes the eight air blowing fans 186 functioning as air blowers and a fan duct 194. The fan duct 194 includes a fan duct opening 194*a* and eight fan attachment openings 194*b*. Air generated by rotating each air blowing fan 186 hits the radiator 181 that is disposed facing the fan duct opening 194*a* of the fan duct 194. By blowing air toward the radiator 181, heat dissipation effect by the radiator 181 increases and cooling capacity by the cooling device 100 is enhanced.

The eight fan attachment openings 194*b* to which the respective air blowing fans 186 are attached. Therefore, space other than respective openings of the air blowing fans 186 and the fan duct opening 194*a* is reduced or eliminated. By reducing or eliminating the space in the fan unit 185, the fan unit 185 connects an air blowing opening 193 (refer to FIG. 8) that functions as an opening of an inner duct 191 that functions as a duct containing the radiator 181, the coolant feed pump 182, and so on. Consequently, the respective air blowing fans 186 increase air blowing effectiveness of air generated in the inner duct 191.

The cooling body 141 of the heat receiver 140 is disposed covering a part of the front-side conveying belt 161 in a sheet width direction, which is a lateral direction of the front-side conveying belt 161, as illustrated in FIG. 3. In the cooling body 141, a substantially parallel line extends in the sheet width direction of a coolant conduit 143. The line has two warped corners on the right side and one warped corner on the left side of the cooling body 141 as illustrated in FIG. 3. Both inlet and outlet of the coolant conduit 143 in the cooling body 141 are arranged on upstream and downstream sides of the coolant conduit 143 in the sheet conveying direction, which is a left end side of the cooling body 141 in FIG. 3. The corresponding rubber tubes 184 of the heat radiating part 180 are connected to the inlet and outlet of the coolant conduit 143.

It is to be noted that the warped corners of the coolant conduit 143 are provided outside a conveying area of the maximum sheet width W of the sheet P that is conveyed in the image forming apparatus 300. This arrangement of the warped corners of the coolant conduit 143 can provide preferable cooling effectiveness even when the sheet P having the maximum sheet width W is fed in the image forming apparatus 300. Specifically, the two warped corners of the coolant conduit 143 on the right side of the cooling body 141 with no inlet and outlet provided thereto are arranged outside and beyond a right end side of the front-side conveying belt 161 in FIG. 3.

In the cooling device 100 having the above-descried configuration, the reverse-side driven rollers 172 are rotated in a counterclockwise direction in FIG. 2, thereby moving the reverse-side conveying belt 171 in the counterclockwise direction endlessly. This endless rotation of the reverse-side conveying belt 171 rotates the front-side conveying belt 161 in contact with the reverse-side conveying belt 171 directly or via the sheet P in a clockwise direction in FIG. 2 endlessly. Consequently, by holding the sheet P between the front-side conveying belt 161 and the reverse-side conveying belt 171 both rotating endlessly, the sheet P after the fixing operation by application of heat can be held and conveyed along the sheet conveying path 32.

The coolant feed pump 182 is driven to circulate the liquid coolant in between the coolant conduits 143 of the cooling body 141 illustrated in FIG. 3 and the radiator 181. The cooling surface 142 of the cooling body 141 contacts the sheet P indirectly via the front-side conveying belt 161, so that the heat of the sheet P is absorbed to cool the sheet P. More specifically, the cooling body 141 includes the coolant conduit 143 that functions as an inner flow path through which the liquid coolant travels. When the cooling surface 142 of the cooling body 141 absorbs the heat (the heat amount) of the sheet P via the front-side conveying belt 161 disposed in contact with the cooling surface 142, the liquid coolant holds the heat to release to an outside of the cooling body 141. Therefore, the cooling body 141 remains at a given low temperature.

The liquid coolant is reserved in the reservoir tank 183. After the coolant feed pump 182 pumps the liquid coolant from the reservoir tank 183, the liquid coolant releases the heat when passing through the inner flow paths 181*a* of the radiator 181. Consequently, the temperature of the liquid coolant is reduced. It is to be noted that the reservoir tank 183 includes an inlet to feed the liquid coolant in the circulating paths of the liquid coolant.

After the temperature has lowered as described above, the liquid coolant absorbs the heat from the cooling body 141 by heat transfer when the liquid coolant passes the coolant conduit 143 of the cooling body 141. Then, the liquid coolant having a higher temperature returns to the reservoir tank 183. While the coolant feed pump 182 is driven, the liquid coolant circulates between the coolant conduit 143 of the cooling body 141 and the inner flow paths 181*a* of the radiator 181 to repeatedly release the heat when the liquid coolant passes the radiator 181 and absorb the heat when the liquid coolant passes the coolant conduit 143 of the cooling body 141.

As described above, in the cooling device 100 according to the present embodiment, the circulating paths in which the liquid coolant is circulated in the order of the coolant feed pump 182, the radiator 181, the cooling body 141, and the reservoir tank 183 if the circulation starts from the coolant feed pump 182, for example.

By circulating the liquid coolant as described above, a length of the coolant conduits by which the liquid coolant is conveyed to the cooling body 141 of the heat receiver 140 can be reduced. Therefore, the liquid coolant that travels in the coolant conduits from an exit of the radiator 181 to the heat receiver 140 is not susceptible to the heat surrounding the coolant conduits. When respective outer circumferential surfaces of the rubber tubes 184 receive heat around the coolant conduits, the temperature of the liquid coolant that flows in the rubber tubes 184 increases, which can result in poor cooling performance. However, this operation can prevent degradation of cooling performance of the cooling device 100.

By cooling the sheet P as described above, the temperature of softened toner after the fixing operation by application of heat in the fixing unit 15 can be reduced for hardening the toner on the sheet P reliably. Therefore, even when the sheet P is discharged to the sheet discharging tray 33 (refer to FIG. 1) in a sheet stack, occurrence of the toner blocking can be prevented.

Next, a description is given of a comparative cooling device 1100 as a comparative example, with reference to FIG. 4.

As illustrated in FIG. 4, the comparative cooling device 1100 is a liquid cooling type device and includes a heat receiver 1140 and a heat radiating part 1180.

The heat receiver 1140 includes a cooling body 1141 that functions as a heat receiving body. The heat radiating part 1180 includes a radiator 1181 that functions as a heat releasing unit, a coolant feed pump 1182, a reservoir tank 1183, and an air blowing fan 1186 that functions as an air blower. The cooling body 1141 of the heat receiver 1140, the radiator 1181 of the heat radiating part 1180, and the reservoir tank 1183 are connected via rubber tubes 1184. Further, the rubber tubes 184 connect the units in the heat radiating part 1180. For example, the radiator 1181 and the coolant feed pump 1182 are connected by one of the rubber tubes 1184, and the coolant feed pump 1182 and the reservoir tank 1183 are connected by a different one of the rubber tubes 1184.

By connecting the units in the cooling device 1100 as described above, circulating paths are formed to circulate the liquid coolant by connecting the radiator 1181, the coolant feed pump 1182, the reservoir tank 1183, and the cooling body 1141 of the heat receiver 1140. Also, a cooling target that is disposed at a position separated from the heat radiating part 1180 contacts the cooling body 1141 of the heat receiver 1140 and transports the heat of the cooling target to the radiator 1181 of the heat radiating part 1180.

The cooling device 1100 illustrated in FIG. 4 includes the single air blowing fan 1186 provided with respect to the single radiator 1181. Air generated by the air blowing fan 1186 hits the radiator 1181 to be absorbed thereto, so as to enhance a heat dissipation effect of the radiator 1181.

The cooling device 1100 illustrated in FIG. 4, however, cannot enhance flexibility of shape of installation space for the radiator 1181 and the air blowing fan 1186 due to the following reasons. Accordingly, it is not likely to achieve a reduction in size of an image forming apparatus and an effective cooling operation with respect to the cooling target.

A fan casing of typical air blowing fans used in a general image forming apparatus has a substantially square shape in vertical cross section in a rotation shaft of fans of the air blowing fan, that is, in an air blowing direction of the air blowing fan. Due to cost and versatility, many typical radiators have a rectangular shape in vertical cross section in a direction that air generated by the air blowing fan hits and passes through the radiators.

The cooling device 1100 has one air blowing fan 1186 with respect to one radiator 1181. The shapes of the radiator 1181 and the air blowing fan 1186 may have the substantially square shapes in vertical cross section in the air blowing direction of the air blowing fan 1186.

For these reasons, if vacant space in the image forming apparatus has a rectangular shape in vertical cross section in the air blowing direction of the air blowing fan and if the rectangular space can obtain a desired heat releasing effect when air hits against the radiator 181 at a given speed, the installation space has no other choice to have a substantially square shape for the radiator 1181 and the blowing fan 1186. Therefore, the entire area of the rectangular shape in vertical cross section of the vacant space in the image forming apparatus cannot be utilize effectively.

Further, due to energy consumption efficiency, it is preferable that a cooling device provided to an image forming apparatus that can handle various types of recording media having different heat amounts for the heat fixing operation can vary the cooling capacity according to the types of recording media.

There are some cooling devices to cool a recording medium according to its paper type, and therefore those cooling devices can vary the cooling capacity depending on the types of recording media.

However, due to the same reasons as the cooling device 1100 illustrated in FIG. 4, these cooling devices cannot be more flexible in shape of the installation space to enhance flexibility of shape where a radiator and an air blowing fan are installed. Therefore, it is not likely to decrease a size of the image forming apparatus and achieve better cooling efficiency for a cooling target.

Now, a detailed description is given of the heat radiating part 180 of the cooling device 100 according to the present embodiment, with reference to FIGS. 5A and 5B.

FIG. 5A is a plan view illustrating the cooling device 100 and FIG. 5B is an elevation illustrating the cooling device 100. Different from the configuration of the comparative cooling device 1100, the cooling device 100 includes the fan unit 185 that functions as an air blowing unit to enhance the heat dissipation effect by blowing air toward the radiator 181, and the fan unit 185 has multiple air blowing fans 186, to be more specific, eight air blowing fans 186 therein, as illustrated in FIGS. 5A and 5B. The units and components other than the fan unit 185 and the air blowing fans 186 in the cooling device 100 are identical in configuration and functions to the comparative cooling device 1100. The multiple air blowing fans 186 are arranged to be controlled individually.

As described above, the multiple air blowing fans 186 are provided with respect to the single radiator 181 to which the air hits. Different from the other cooling devices including the cooling device 1100 illustrated in FIG. 4, the shape of the radiator 181 is not limited to a substantially square shape of each air blowing fan 186.

For example, as illustrated in FIG. 5B, two air blowing fans 186 can be arranged vertically and four air blowing fans 186 can be arranged horizontally in the fan unit 185 or three air blowing fans 186 can be arranged horizontally. Accordingly, when the radiator 181 is disposed in a direction perpendicular to the air blowing direction of air generated by each air blowing fan 186, the radiator 181 can be arranged in a rectangular shape.

Specifically, by disposing the multiple air blowing fans 186 with respect to the single radiator 181, the shape of the radiator 181 can be rectangular.

Therefore, compared with the cooling device 1100 illustrated in FIG. 4, the installation space of the radiator 181 and the multiple air blowing fans 186 (in the fan unit 185) can be more flexible in the image forming apparatus 300 according to the present embodiment.

As a result, compared with the cooling device 1100 illustrated in FIG. 4, the entire area of the rectangular shape in vertical cross section of the vacant space in the image forming apparatus 300 can be utilized effectively as the installation space of the radiator 181 and the fan unit 185.

Further, the cooling device 100 illustrated in FIGS. 5A and 5B, the multiple air blowing fans 186 are controlled individually according to the type of the sheet P, so as to vary the cooling capacity of the cooling device 100. Therefore, the cooling capacity of the cooling device 100 can vary according to the type of the sheet P for image forming. This can respond to the request that the number of types of recording media is increased.

Therefore, with this configuration and functions, the cooling device 100 that is incorporated in the image forming apparatus 300 can cool efficiently the sheet P that is a cooling target according the type of the sheet P and can utilize the installation space available in the image forming apparatus 300.

Next, a further detailed description is given of the heat radiating part 180 included in the cooling device 100 according to the present embodiment, with reference to drawings and tables illustrated in FIGS. 6 through 12.

Figure 6:
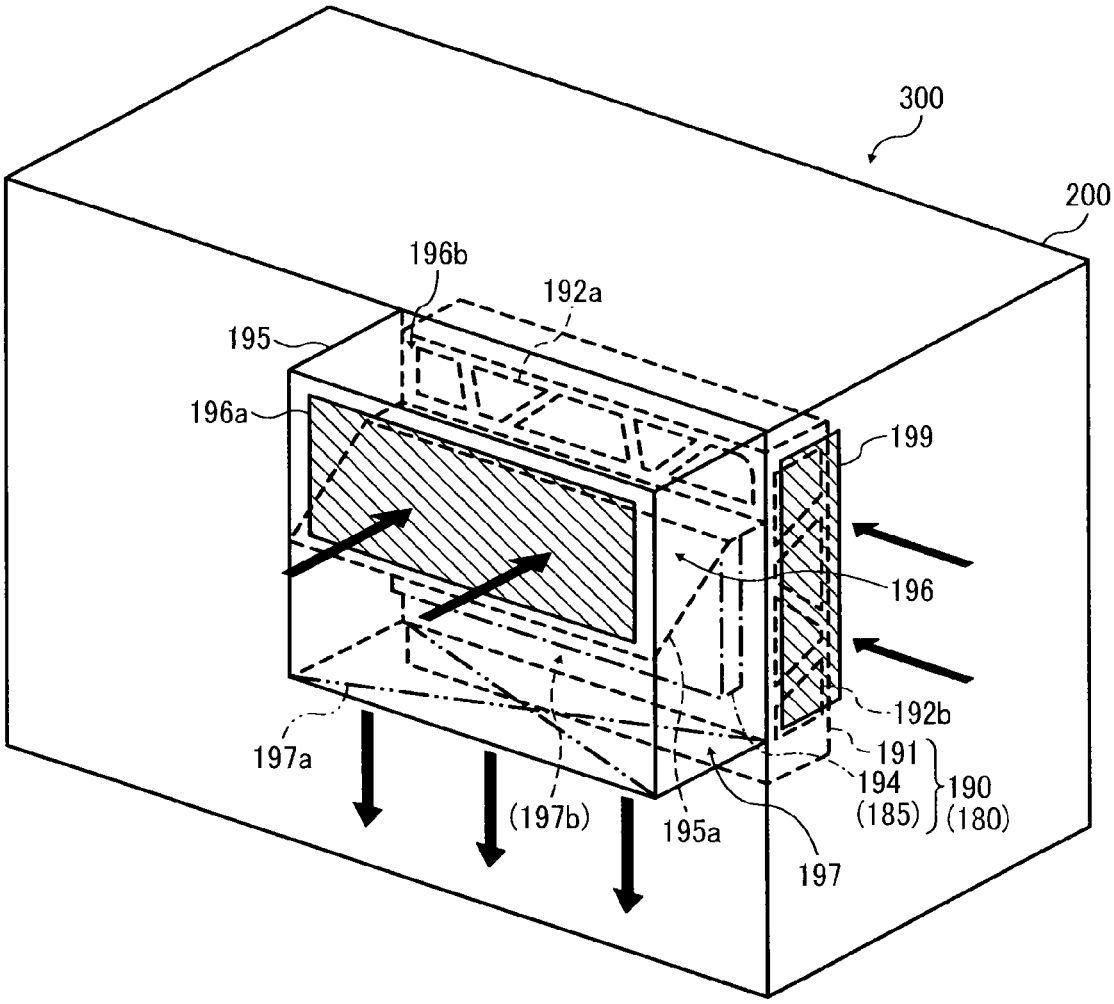
FIG. 6 is a perspective view illustrating the cooling device viewed from a back of the image forming apparatus.
Figure 7:
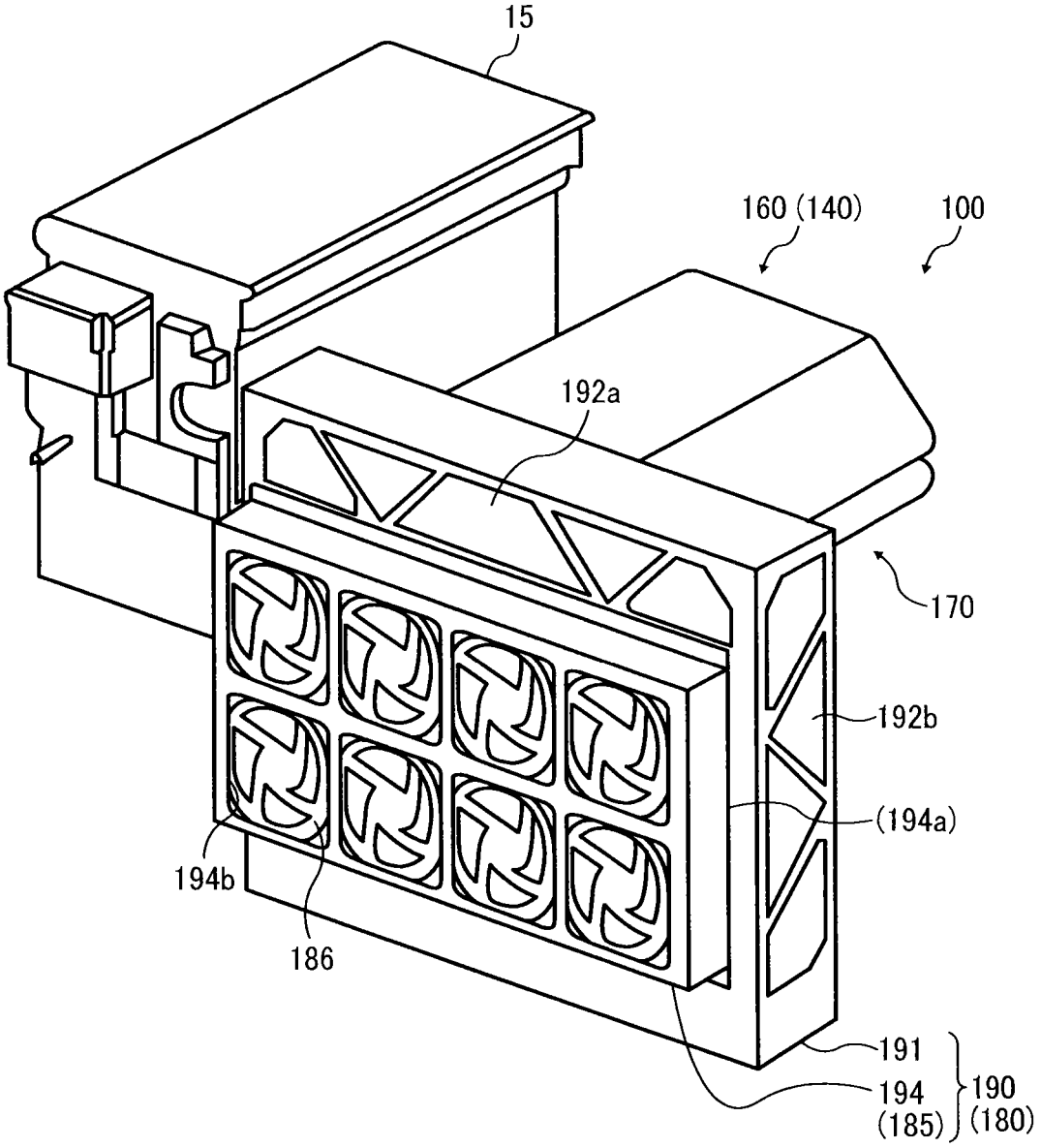
FIG. 7 is a perspective view illustrating the cooling device with an outer duct removed from a heat releasing part of the cooling device.
Figure 8:
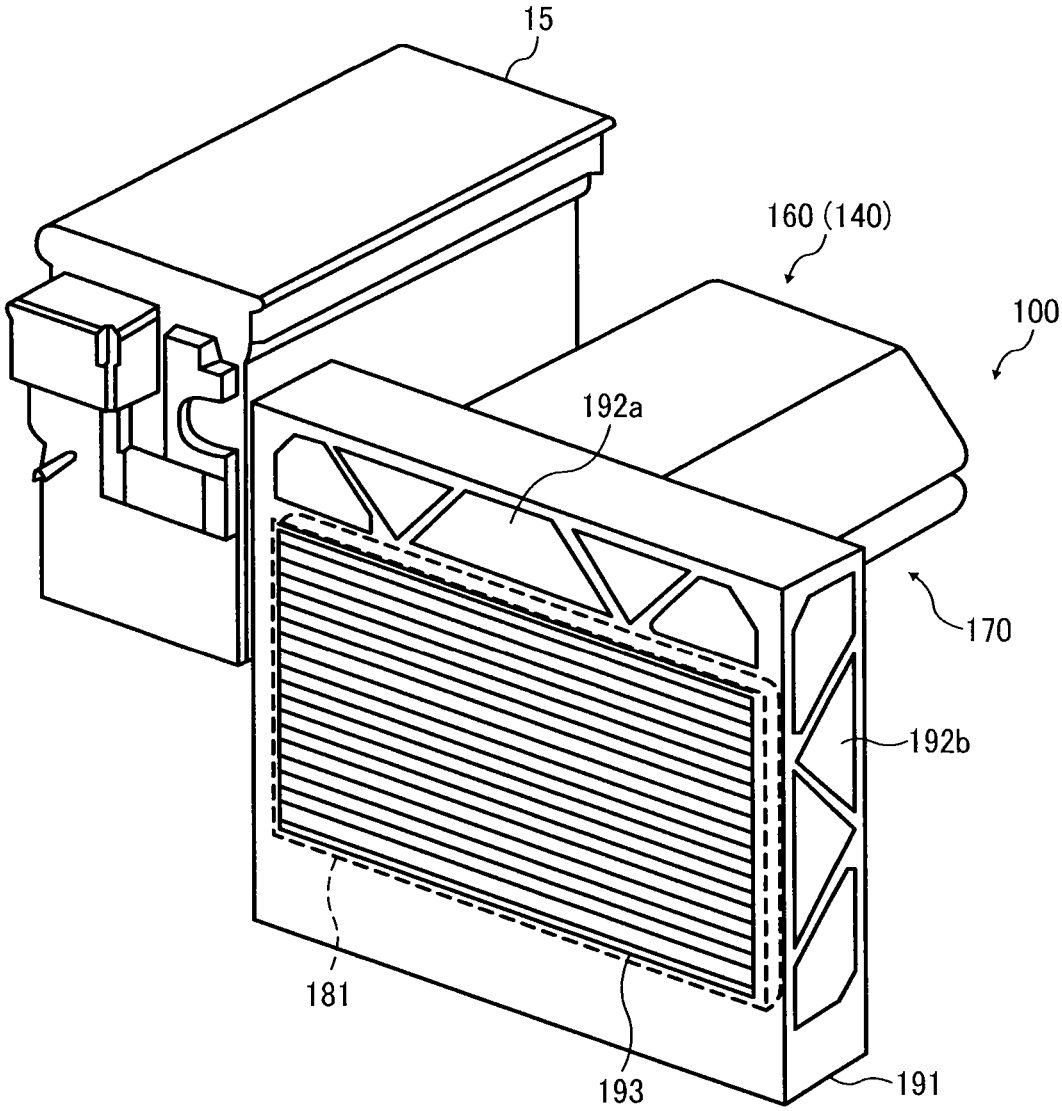
FIG. 8 is a perspective view illustrating the cooling device of FIG. 7 with a fan unit removed from the heat releasing part of the cooling device.
Figure 9:
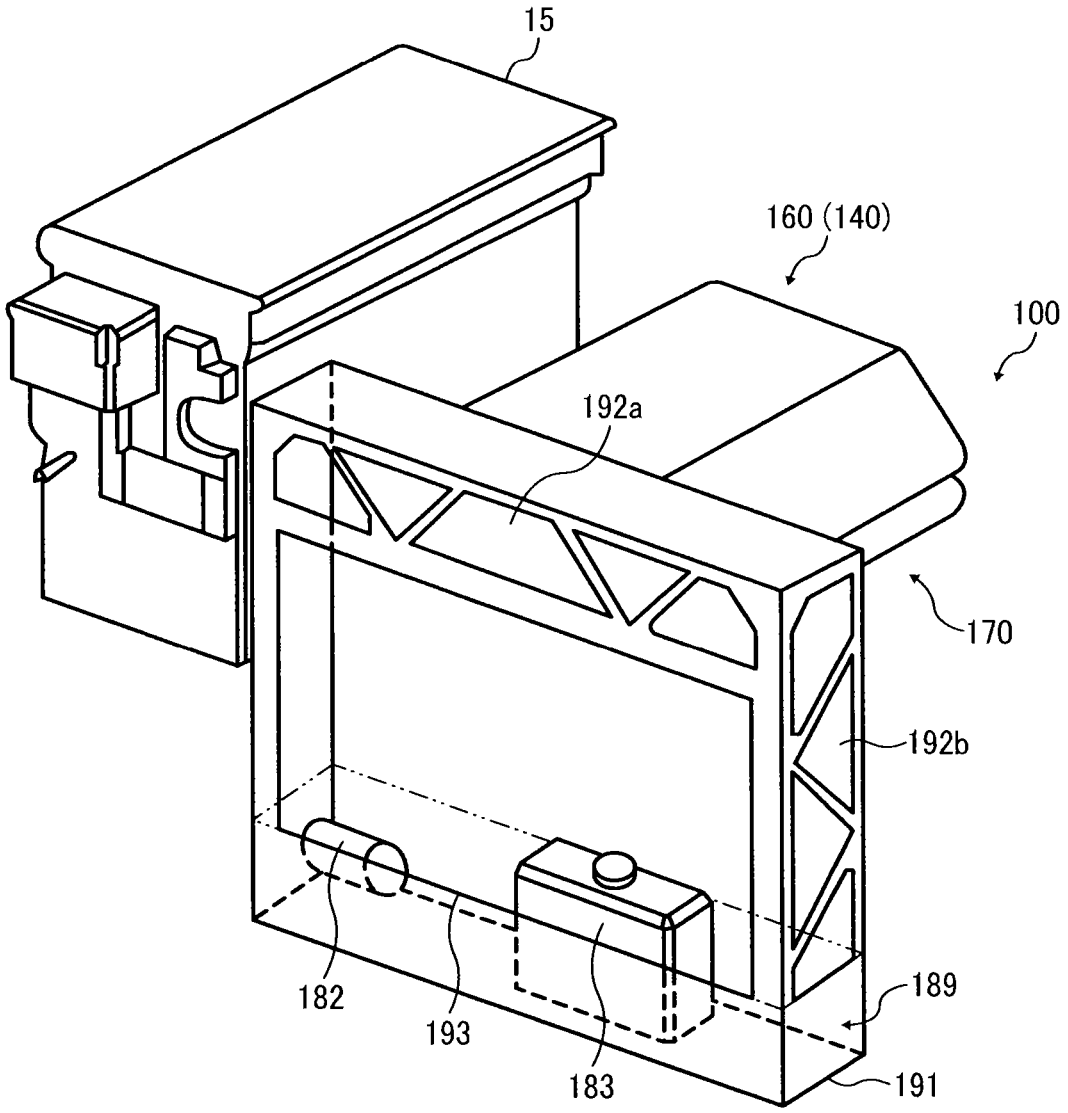
FIG. 9 is a perspective view illustrating the cooling device of FIG. 8 with a radiator removed from the heat releasing part of the cooling device.

FIG. 6 is a perspective view illustrating the cooling device 100 viewed from the back of the image forming apparatus 300. FIG. 7 is a perspective view illustrating the cooling device 100 with an outer duct 195 removed from the heat radiating part 180. FIG. 8 is a perspective view illustrating the cooling device 100 of FIG. 7 with the fan unit 185 removed from the heat radiating part 180. FIG. 9 is a perspective view illustrating the cooling device 100 of FIG. 8 with the radiator 181 removed from the heat radiating part 180.

Figure 10A:
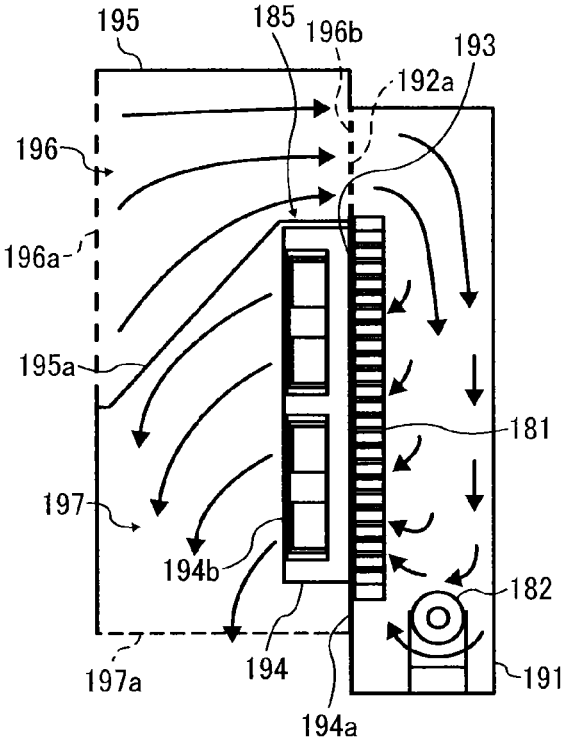
FIGS. 10A through 10C are diagrams illustrating air flow and air flow paths in the heat releasing part of the cooling device.
Figure 10B:
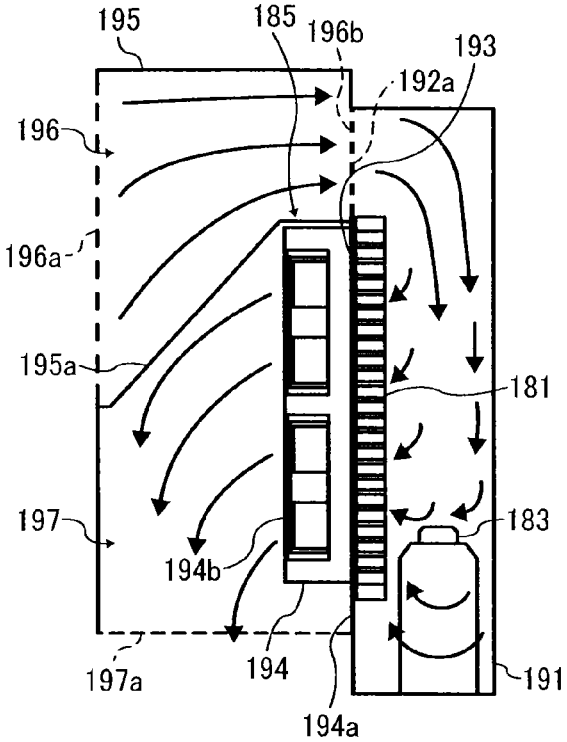
Figure 10C:
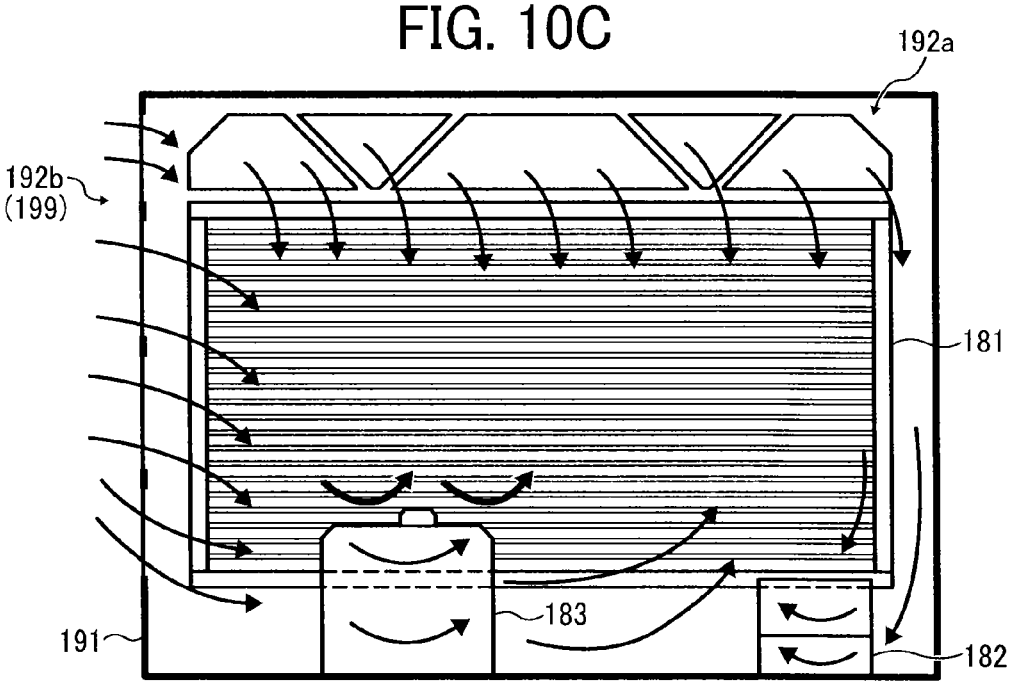
Figure 11A:
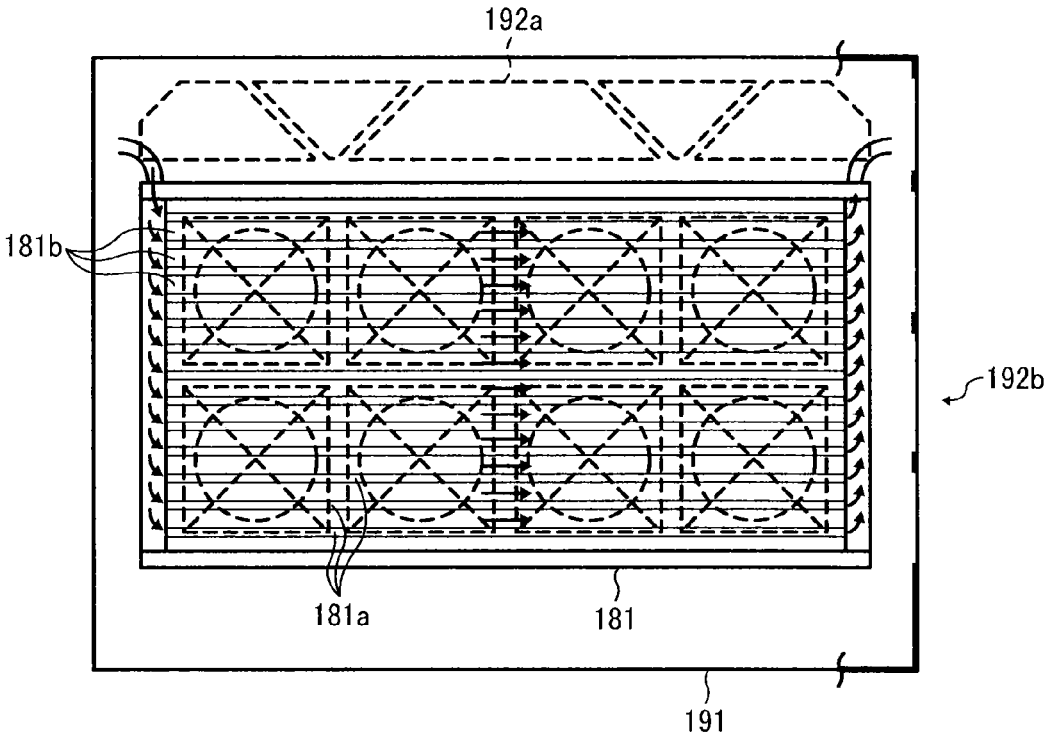
FIGS. 11A and 11B are diagrams illustrating respective positions of air blowing fans in the fan unit and the radiator of the cooling device.
Figure 11B:
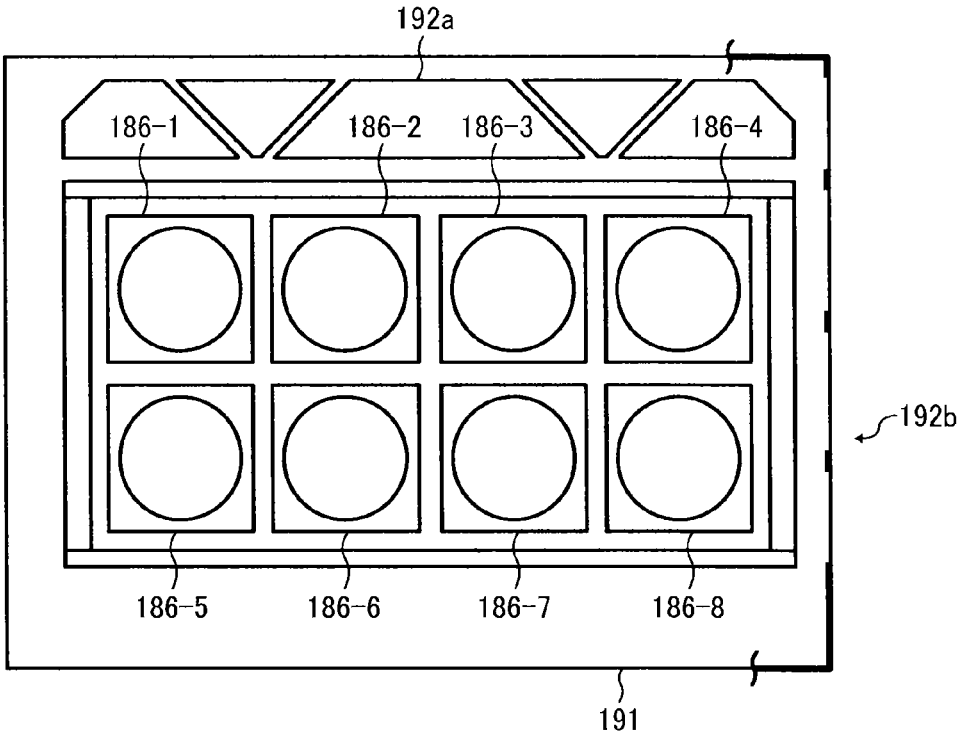
Figure 12:
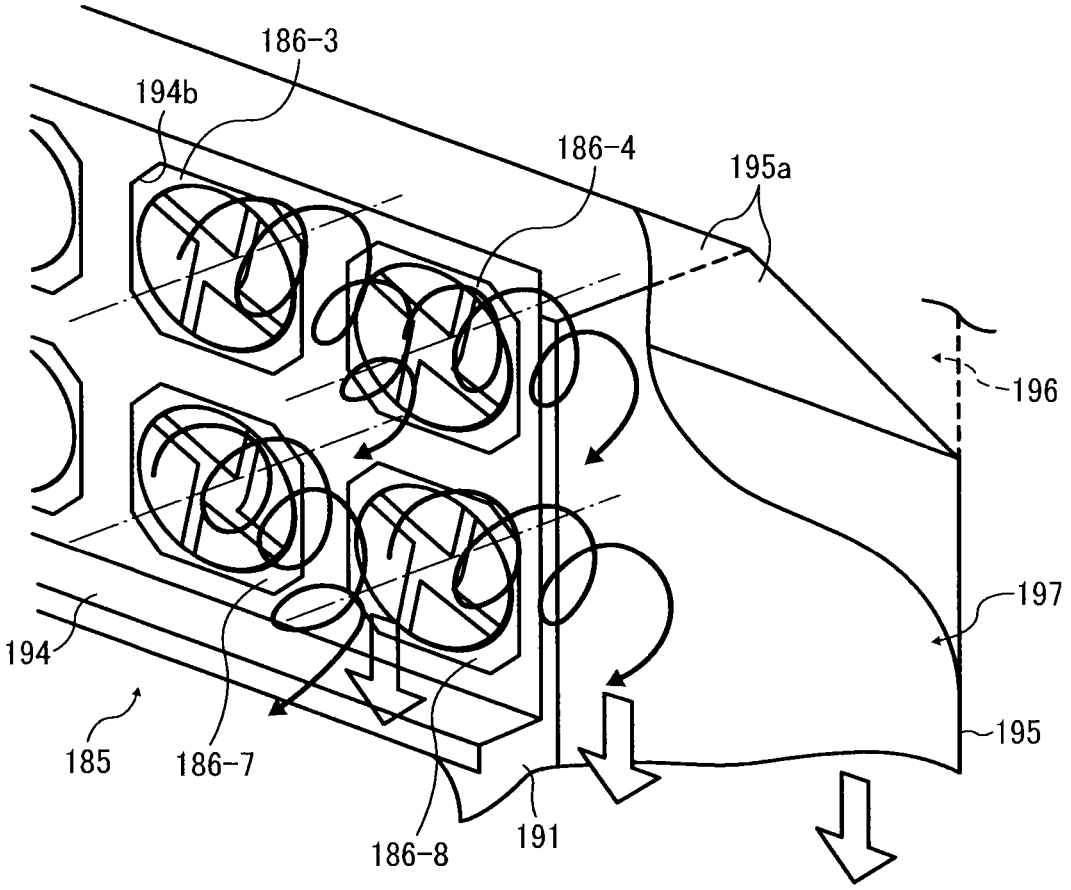
FIG. 12 is a perspective view illustrating air flow from four air blowing fans disposed on the left side of the fan unit.

FIGS. 10A through 10C are diagrams illustrating air flow (paths) in the inner duct 191 of the cooling device 100. FIG. 10A is a cross sectional view when viewing the coolant feed pump 182 from the left side (the downstream side in the sheet conveying direction) of the image forming apparatus 300. FIG. 10B is a cross sectional view when viewing the reservoir tank 183 from the left side (the downstream side in the sheet conveying direction) of the image forming apparatus 300. FIG. 10C is a cross sectional view when viewing the coolant feed pump 182 and the reservoir tank 183 from the front side of the image forming apparatus 300. FIGS. 11A and 11B are diagrams illustrating respective positions of the air blowing fans 186 in the fan unit 185 and the radiator 181 of the cooling device 100 according to the present embodiment. Specifically, FIG. 11A shows the radiator 181 and a layout of the inner flow paths of the radiator 181. FIG. 11B shows a layout of the eight air blowing fans 186 in the fan unit 185 that is disposed facing the radiator 181 and respective reference numerals of the air blowing fans 186. FIG. 12 is a perspective view illustrating air flow from four air blowing fans 186 on the left side of the fan unit 185.

As illustrated in FIG. 2, the fan unit 185 that functions as an air blowing unit according to the present embodiment includes eight air blowing fans 186. The cooling device 100 according to the present embodiment cools the sheet P after completion of the fixing operation by heat and pressure in the fixing unit 15 while various types of the sheets P are used for image formation in the image forming apparatus 300. Accordingly, the maximum amount of heat that is released by the heat radiating part 180 is greater than the maximum amount of heat that is releases when cooling the development unit 3 (i.e., the development units 3Y, 3C, 3M, and 3K). Therefore, the fan unit 185 includes the multiple air blowing fans 186 therein.

Specifically, the image forming apparatus 300 can form an image on any of a wide variety of types of the sheets P having different amounts of heat used for image fixing due to different heat capacity and heat conductivities. For example, the variety of types of the sheets P includes plain paper (PPC paper), recycled paper, and special paper such as coated paper. Further, the image forming apparatus 300 can form an image on any of the sheets P in a range of from a relatively low basis weight such as thick paper to a relatively high basis weight such as thick paper.

The image forming apparatus 300 has two printing modes, which are a simplex print mode and a duplex print mode to offer simplex and duplex printing with the above-described sheets P. Due to the difference in these print modes, the sheet P passes the fixing nip contact area for different times before being sent to the cooling device 100 to cool the sheet P, and therefore receives different amounts of heat from the fixing unit 15.

Table 1 shows possible combinations of the types of the sheets P and the print modes used in the image forming apparatus 300 with basis weight (sheet thickness).

TABLE 1

| Paper | Paper Type | Plain Paper | Recycled Paper | Coated Paper (Special Paper) |
|---|---|---|---|---|
| Basis Weight | | 50 gsm-400 gsm | | |
| Print Mode | | Simplex/Duplex | | |

If the sheet P such as coated paper having a large basis weight is fixed, it is difficult for the fixing operation by heat and pressure, and therefore an amount of heat to be absorbed in the cooling device 100 approaches the maximum amount of heat. However, if the sheet P such as plain paper having a small basis weight is fixed, since the fusing performance is good, and the small amount of heat is absorbed in the cooling device 100.

Therefore, regardless of types of the sheets P, if the cooling device 100 constantly applies the maximum cooling capacity thereof when cooling the sheet P, the energy is wasted and a level of noise such as air/wind sound of each air blowing fan 186 and drive sound of each motor is constantly high. Further, not in the cooling device 100 that cools the sheet P after completion of the fixing operation by heat and pressure but in a cooling device that cools developer contained in the development unit 3, for example, a temperature of the developer becomes so low that other inconveniences are likely to occur.

In order to avoid the above-described inconvenience, the cooling device 100 according to the present embodiment adjusts the cooling capacity thereof according to the type of the sheet P depending on combinations of ON/OFF of rotation of each air blowing fan 186 among the eight air blowing fans 186 in the fan unit 185.

The cooling device 100 according to the present embodiment has a configuration in which the air is blown to hit the radiator 181 to enhance the heat dissipation effect of the radiator 181. In the configuration of the cooling device 100, the heat dissipation effect can differ depending on a temperature of the air to be blown to the radiator 181 in addition to the amount of air flow toward the radiator 181. Therefore, in the cooling device 100 according to the present embodiment, a given selected number of the air blowing fans 186 is turned on to rotate according to the type of the sheet P within a given range of environmental temperature for the image forming apparatus 300. Hereinafter, the environmental temperature is referred to as "ambient temperature". Further, as described above, the image forming apparatus 300 has different amounts of heat transferred from the fixing unit 15 to the sheet P. Therefore, different quantities of the air blowing fans 186 to rotate depending on the simplex and duplex print modes in the image forming apparatus 300.

It is to be noted that the number of air blowing fans 186 to rotate depending on the above-described conditions is previously determined based on test results and stored in a memory of the cooling device controller 110 of the cooling device 100. When the cooling device 100 cools the sheet P, the cooling device controller 110 performs an ON/OFF control of rotation of each air blowing fan 186 depending on the above-described conditions.

Table 2 shows example quantities of the eight air blowing fans 186 arranged in the fan unit 185 under the ON/OFF control depending on the above-described conditions. It is to be noted that, in an ON state of the ON/OFF control determined by the cooling device controller 110, the given number of the air blowing fans 186 is rotated at a given rotation speed based on the test results or a rated speed of rotation of the air blowing fan(s) 186. By contrast, in an OFF state of the ON/OFF control, no air blowing fans 186 is rotated.

TABLE 2

| Ambient Temperature (Temp.) X | Paper Type | Print Mode | Basis Weight: Below 100 gsm | 100 gsm-149 gsm | 150 gsm-299 gsm | 300 gsm-400 gsm |
|---|---|---|---|---|---|---|
| X < A | Plain Paper | Simplex | 1 | 1 | 2 | 4 |
| | | Duplex | 1 | 1 | 2 | 4 |
| | Coated Paper | Simplex | 1 | 1 | 2 | 4 |
| | | Duplex | 1 | 1 | 2 | 8 |

TABLE 2-continued

| Ambient Temperature (Temp.) X | Paper Type | Print Mode | Basis Weight Below 100 gsm | 100 gsm-149 gsm | 150 gsm-299 gsm | 300 gsm-400 gsm |
|---|---|---|---|---|---|---|
| A ≤ X < B | Plain | Simplex | 1 | 2 | 2 | 8 |
| | Paper | Duplex | 1 | 2 | 2 | 8 |
| | Coated | Simplex | 1 | 2 | 4 | 8 |
| | Paper | Duplex | 1 | 2 | 4 | 8 |
| B ≤ X | Plain | Simplex | 1 | 2 | 4 | 8 |
| | Paper | Duplex | 1 | 2 | 4 | 8 |
| | Coated | Simplex | 2 | 4 | 8 | 8 |
| | Paper | Duplex | 2 | 4 | 8 | 8 |

Here, the ambient temperature is referred to as an "ambient temperature X", a given lower temperature is referred to as a "lower given temperature A", and a given upper temperature is referred to as an "upper given temperature B", as described in Table 2. For example, under a condition in which the ambient temperature X is below the given lower temperature A (X<A), if the sheet P conveyed for image forming is a coated paper (paper type) having the basis weight of 400 gsm to be printed in the duplex print mode, the entire (eight) air blowing fans 186 are rotated at the full speed (the rated rotation speed) as shown in Table 2.

The entire (eight) air blowing fans 186 are rotated because the sheet P is a coated paper having the basis weight of 400 gsm, requires a large amount of heat for fixing by heat and pressure, and passes the fixing unit 15 two times for duplex printing. Therefore, the amount of heat absorbed from the sheet P by the cooling body 141 of the heat receiver 140 increases. In a case in which the large amount of heat is to be absorbed from the sheet P as described above, the amount of heat to be released in the heat radiating part 180 approaches the maximum amount of releasable heat in the heat radiating part 180. For those reasons, the entire (eight) air blowing fans 186 are to be operated at the full speed, so as to increase the heat dissipation effect of the radiator 181.

By contrast, even under the condition in which the ambient temperature X is below the given lower temperature A, if the sheet P is a plain paper having the basis weight of 70 gsm to be printed in the simplex print mode, one of the eight air blowing fans 186 is rotated at the rated rotation speed as shown in Table 2.

The selected one of the air blowing fans 186 is rotated because the sheet P is a plain paper having the basis weight of less than 100 gsm, requires a small amount of heat for fixing by heat and pressure, and passes the fixing unit 15 one time for simplex printing. Therefore, the amount of heat absorbed from the sheet P by the cooling body 141 of the heat receiver 140 decreases. In a case in which the small amount of heat is to be absorbed from the sheet P as described above, the amount of heat to be released in the heat radiating part 180 is also reduced. For those reasons, the selected one of the eight air blowing fans 186 is to be operated, so as to obtain the heat dissipation effect of the radiator 181.

With the combinations of ON/OFF of rotation of the multiple air blowing fans 186 (eight fans in the present embodiment) in the fan unit 185, the cooling capacity of the cooling device 100 can be adjusted according to the type of the sheet P. Consequently, a reduction in power consumption during image formation, a decrease in noise, and other effects can be achieved.

Next, a description is given of an active (ON) operation of a single air blowing fan 186 of the eight air blowing fans 186 based on the combination of ON/OFF of rotation of the air blowing fans 186 in the fan unit 185 of the cooling device 100 according to the present embodiment.

Referring to FIG. 6, a configuration of the heat radiating part 180 of the cooling device 100 is described for selecting the single air blowing fan 186 to turn on to rotate.

FIG. 6 depicts a position of the heat radiating part 180 and relations of the heat radiating part 180, the outer duct 195 attached to the heat radiating part 180, and an exterior panel of the apparatus body 200.

As illustrated in FIG. 6, the heat radiating part 180 is disposed inside a portion adjacent to panels on the back and left sides of the exterior panel of the apparatus body 200 of the image forming apparatus 300. By providing the heat radiating part 180 as described above, outside air is taken from a first passage opening part 192*a* and a second passage opening part 192*b*, both function as two openings of the inner duct 191, and the air that is heated in the apparatus body 200 is exhausted from the fan attachment openings 194*b* of the fan unit 185 to the outside of the apparatus body 200 easily.

Specifically, the fan unit 185 projects outside from the back of the apparatus body 200. The first passage opening part 192*a* of the inner duct 191 is arranged at an upper part of the fan unit 185 and the second passage opening part 192*b* of the inner duct 191 is arranged at a lower part on the back of the apparatus body 200. The outer duct 195 is a duct connected to the first passage opening part 192*a* and the fan unit 185 on the back thereof. According to the outer duct 195, the outside air is drawn to the first passage opening part 192*a* from the back of the apparatus body 200 to guide the air blown from the fan unit 185 to the lower part of the back of the apparatus body 200. Further, the apparatus body 200 has an opening on the left side of the back thereof, so that the opening is disposed facing the second passage opening part 192*b* of the inner duct 191 to guide the outside air to the second passage opening part 192*b* from the left side of the apparatus body 200.

The outer duct 195 has an exterior of a substantially rectangular solid shape. No opening for air passing therethrough is provided on sidewalls on the top, right, and left sides of the outer duct 195. A first outer opening 196*a* is provided on a sidewall on an upper part of the back of the outer duct 195. Respective openings are provided on the sidewall on the lower part of the back and on a sidewall that is disposed facing the apparatus body 200. An outer duct partition 195*a* is provided as a partition in the outer duct 195 to separate the outer duct 195 to a first outer duct 196 and a second outer duct 197. The first outer duct 196 functions as a duct through which air taken from the first passage opening part 192*a* passes. The second outer duct 197 functions as a duct through which air exhausted from the fan unit 185 that functions an air blowing unit passes.

A first outside communication opening 196*b* is provided on a sidewall of the first outer duct 196 facing the inner duct 191. The first outside communication opening 196*b* is formed by connecting three sidewalls of the outer duct 195 and the outer duct partitions 195*a* to four sidewalls of the inner duct 191. By contrast, multiple slits are provided on the first outer opening 196*a* to let the air pass therethrough and prevent foreign materials. By providing the first outer duct 196 as described above, air (outside air) flow paths are provided from the back space of the outer duct 195 that projects toward the back of the apparatus body 200 to the inner duct 191 via the first passage opening part 192*a*.

A second outside communication opening 197*b* is provided on a sidewall of the second outer duct 197 facing the inner duct 191. The second outside communication opening 197*b* is formed by connecting two sidewalls of the outer duct 195 and the outer duct partitions 195*a* to three sidewalls of the inner duct 191 around the fan unit 185. Further, the second outside communication opening 197*b* communicates with a second outer opening 197*a* that functions as a lower opening of the second outer duct 197.

It is to be noted that wire mesh is attached to the second outer duct 197 according to the present embodiment to let the air pass therethrough and prevent foreign materials. By providing the second outer duct 197 as described above, air (outside air) flow paths for air exhausting from the inner duct 191 due to the fan unit 185 are provided to a lower space of the outer duct 195 that projects toward the back of the apparatus body 200.

Further, the exterior panel on the left side of the apparatus body 200 has an opening facing the second passage opening part 192*b* of the inner duct 191. A slit panel 199 that has multiple slits thereon is attached to the opening on the exterior panel. The slit panel 199 is provided to let the air pass therethrough and prevent foreign materials. By providing an adjacent area of the second passage opening part 192*b* of the inner duct 191 as described above, outside air flow paths are formed to intake air therethrough to an inside of the inner duct 191 from the left side space of the apparatus body 200 via the second passage opening part 192*b*. It is to be noted that it is preferable to connect the slit panel 199 disposed facing the second passage opening part 192*b* to the side wall of the inner duct 191 having the second passage opening part 192*b* and to provide a partition so that the air does not enter from other space inside the apparatus body 200.

Next, a detailed description is given of the fan duct 194 and the inner duct 191 of the heat radiating part 180, with reference to FIGS. 7 through 9.

FIG. 7 shows the units and components of the cooling device 100 in the image forming apparatus 300. Specifically, the units and components include the fixing unit 15, the front-side holding part 160, the reverse-side holding part 170, and the heat radiating part 180. The fixing unit 15 applies heat to the sheet P that is a cooling target to be cooled by the cooling device 100. The front-side holding part 160 includes the heat receiver 140 to absorb heat from the sheet P. The reverse-side holding part 170 is disposed facing the front-side holding part 160.

The heat radiating part 180 includes the inner duct 191 that forms a heat releasing casing 190 together with the fan duct 194 and forms the heat radiating part 180 together with the fan duct 194 and the fan unit 185 having the eight air blowing fans 186. The inner duct 191 has a shape of substantially rectangular parallelepiped or substantially cuboid. The inner duct 191 is connected with the fan unit 185 on a sidewall of the back thereof, has the first passage opening part 192*a* in the upper part, and has the second passage opening part 192*b* on a sidewall on the left side. The first passage opening part 192*a* has five openings divided by four reinforcement members. The second passage opening part 192*b* has four openings divided by three reinforcement members.

The fan unit 185 has the eight air blowing fans 186 respectively attached to the eight fan attachment openings 194*b* on the sidewall on the back of the fan duct 194. The fan duct opening 194*a* (refer to FIG. 10) is attached to the sidewall facing the fan attachment opening 194*b* and is connected to the air blow opening 193 of the inner duct 191.

The radiator 181 is attached to the air blow opening 193 from the inside of the inner duct 191 as illustrated in FIG. 8. The radiator 181 includes multiple air flow spaces 181*b* through which air passes. The multiple air flow spaces 181*b* are partitioned by multiple liquid cooling tubes corresponding to the multiple inner flow paths 181*a* and multiple cooling fins. By attaching the radiator 181 having the multiple air flow spaces 181*b* to the air blow opening 193 from the inside of the inner duct 191, a substantially entire amount of air that passes the air blow opening 193 through the multiple air flow spaces of the radiator 181.

As illustrated in FIG. 9, the coolant feed pump 182 and the reservoir tank 183 are disposed at the front side (the inside) of the radiator 181 of the inner duct 191.

As illustrated in FIG. 9, the inner duct 191 has a sidewall on which the air blow opening 193 and the first passage opening part 192*a* are formed and another sidewall on which the second passage opening part 192*b* is formed. These sidewalls are mutually arranged perpendicularly. Further, the other four sidewalls of the inner duct 191 have no opening through which outside air from the fan unit 185 passes.

The inner duct 191 also has a part that extends below the air blow opening 193, the first passage opening part 192*a*, and the second passage opening part 192*b*, specifically below the lower part of the air blow opening 193 that is indicated by a two-dot chain line in FIG. 9. The extended part corresponds to a receiver 189 that receives liquid coolant leaked from mechanical units contained in the inner duct 191. The units include the radiator 181, the coolant feed pump 182, and the reservoir tank 183 and so forth.

By having the receiver 189 described above, even if the liquid coolant is leaked from the units contained in the inner duct 191, the receiver 189 can receive the leaked liquid coolant. As a result, this configuration can prevent inconvenience caused by moisture of the sheet P and the parts such as the reverse path 36 in the image forming apparatus 300 having the cooling device 100.

It is to be noted that the capacity of the receiver 189 has preferably the maximum amount of liquid coolant that can be leaked in the inner duct 191.

As described in FIGS. 7 through 9, by providing the inner duct 191 and the units contained in the inner duct 191, air flow paths through which wind (air) from the fan unit 185 passes can be provided in the inside of the inner duct 191. FIGS. 10A, 10B, and 10C show the air flow paths through which the air generated from the fan unit 185 passes when the eight air blowing fans 186 in the fan unit 185 are rotated.

In a cross section on the left side of an area where the coolant feed pump 182 is disposed as illustrated in FIGS. 10A and 10C, the air flow paths of air taken from the first passage opening part 192*a* and the second passage opening part 192*b* extend to a part lower than a lower limit of the air flow space of the radiator 181.

Further, in a cross section on the left side of an area where the reservoir tank 183 is disposed as illustrated in FIGS. 10B and 10C, the air flow paths of air taken from the first passage opening part 192*a* and the second passage opening part 192*b* extend to the part lower than the lower limit of the air flow space of the radiator 181.

As described above, the radiator 181 is connected to the air blow opening 193 from the inside of the inner duct 191. According to this configuration, the substantially entire amount of air that passes between the air blow opening 193 or the first passage opening part 192*a* and the second passage opening part 192*b* passes through the multiple air flow spaces 181*b* formed in the radiator 181. Consequently, the heat dissipation effect by the radiator 181 is increased and the cooling effectiveness of the cooling device 100 is enhanced.

Further, as illustrated in FIG. 10C, the air from the first passage opening part 192*a* and the second passage opening part 192*b* is taken efficiently and passes the radiator 181 on the left side of the radiator 181 (on the left side of the apparatus body 200). Therefore, a resistance of air blowing on the left side of the radiator 181 becomes smaller than the other parts and an amount of the air becomes greater than the other parts.

As described above with reference to FIG. 6, the fan unit 185 is connected via the inner duct 191 to the second outer duct 197 of the outer duct 195 that guides the air in a direction different from a direction in which the air passes through the first passage opening part 192*a* and the second passage opening part 192*b*.

As described above, by connecting to the second outer duct 197, it can reduce or prevent that a part of the air at a temperature increased after passing the radiator 181 circulates outside the inner duct 191 without mixing with the outside air. Therefore, degradation of the cooling effectiveness of the cooling device 100 is prevented.

Further, as described with reference to FIG. 6, the air blows in a substantially vertical downward direction from the second outer duct 197 of the present embodiment.

By so doing, it can prevent that the air from the cooling device 100 hits a user at work in the vicinity of the image forming apparatus 300 having the cooling device 100 to discomfort. Further, it can also prevent that driving noise of the fan unit 185 gives discomfort to the user.

As illustrated in FIG. 11A, the multiple inner flow paths 181*a* of the radiator 181 are formed substantially parallel and aligned in parallel from an upstream side (a right side of the apparatus body 200) that is connected to the coolant feed pump 182 to a downstream side that is connected to the reservoir tank 183. It is to be noted that the coolant conveying tubes forming the multiple inner flow paths 181*a* of the radiator 181 have multiple heat releasing fins disposed in a direction perpendicular to an axial direction of the coolant conveying tubes, so that the multiple air flow spaces 181*b* are formed by the multiple coolant conveying tubes and the multiple heat releasing fins. Further, it is to be noted that, even though leading lines in FIG. 11A do not indicate each of the multiple inner flow paths 181*a* and the multiple air flow spaces 181*b*, the radiator 181 has the multiple inner flow paths 181*a* and the multiple air flow spaces 181*b* aligned alternately over the entire area thereof.

Then, four of the air blowing fans 186 in the fan unit 185 are arranged at respective positions on the upper half area of the radiator 181 and the other four of the air blowing fans 186 in the fan unit 185 are arranged at respective positions on the lower half area of the radiator 181, as illustrated in FIG. 11B.

Thus, two of the air blowing fans 186 are aligned vertically and four horizontally in the fan unit 185, so that the fan unit 185 faces the radiator 181 in which the multiple substantially parallel inner flow paths.

By providing the fan unit 185 with the air blowing fans 186 aligned in the above-described formation, the following effects can be achieved. For example, when two of the air blowing fans 186 are to be rotated, one of the upper four air blowing fans 186 and one of the lower four air blowing fans 186 are turned on. By turning on these two air blowing fans 186, the heat dissipation effect of the radiator 181 can be more enhanced when compared with a configuration in which the two air blowing fans 186 are selected from either one of the upper four air blowing fans 186 or the lower four air blowing fans 186. This is because the heat dissipation effect of the radiator 181 increases more as a difference of a temperature of the air that passes through the multiple air flow spaces 181*b* formed by the inner flow paths 181*a* and the heat releasing fins and a temperature of the liquid coolant that passes in the inner flow paths 181*a* becomes greater.

Hereinafter, the air blowing fans 186 are referred to as the air blowing fans 186-1 through 186-8 in order to explain respective combinations of the air blowing fans 186 to be rotated. Specifically, in the order of respective positions from a far side to a near side of the second passage opening part 192*b*, the upper four air blowing fans 186 are referred to as the air blowing fans 186-1, 186-2, 186-3, and 186-4, and the lower four air blowing fans 186 are referred to as the air blowing fans 186-5, 186-6, 186-7, and 186-8.

As illustrated in FIG. 6, the air blown from the air blowing fans 186 is guided in the substantially vertically downward direction by the second outer duct 197 of the outer duct 195 so as to flow as illustrated in FIG. 12.

As illustrated in FIG. 12, the air from the air blowing fans 186 are restricted by two substantially vertical sidewalls of the outer duct 195 and the outer duct partition 195*a* that extends substantially parallel by a given length and is obliquely bent beyond the edge of the parallel part thereof. The air from the thus-restricted air blowing fans 186 flow in a clockwise spiral toward the top in the drawing as illustrated in FIG. 12. The air is then bent along the outer duct partition 195*a* and the front sidewall to be guided in a substantially vertically downward direction.

The result of a measurement conducted by the inventors clearly shows that the air blowing fans 186 have different air amounts according to respective positions (with respect to the first passage opening part 192*a*, the second passage opening part 192*b*, and the outer duct 195).

Figure 13:
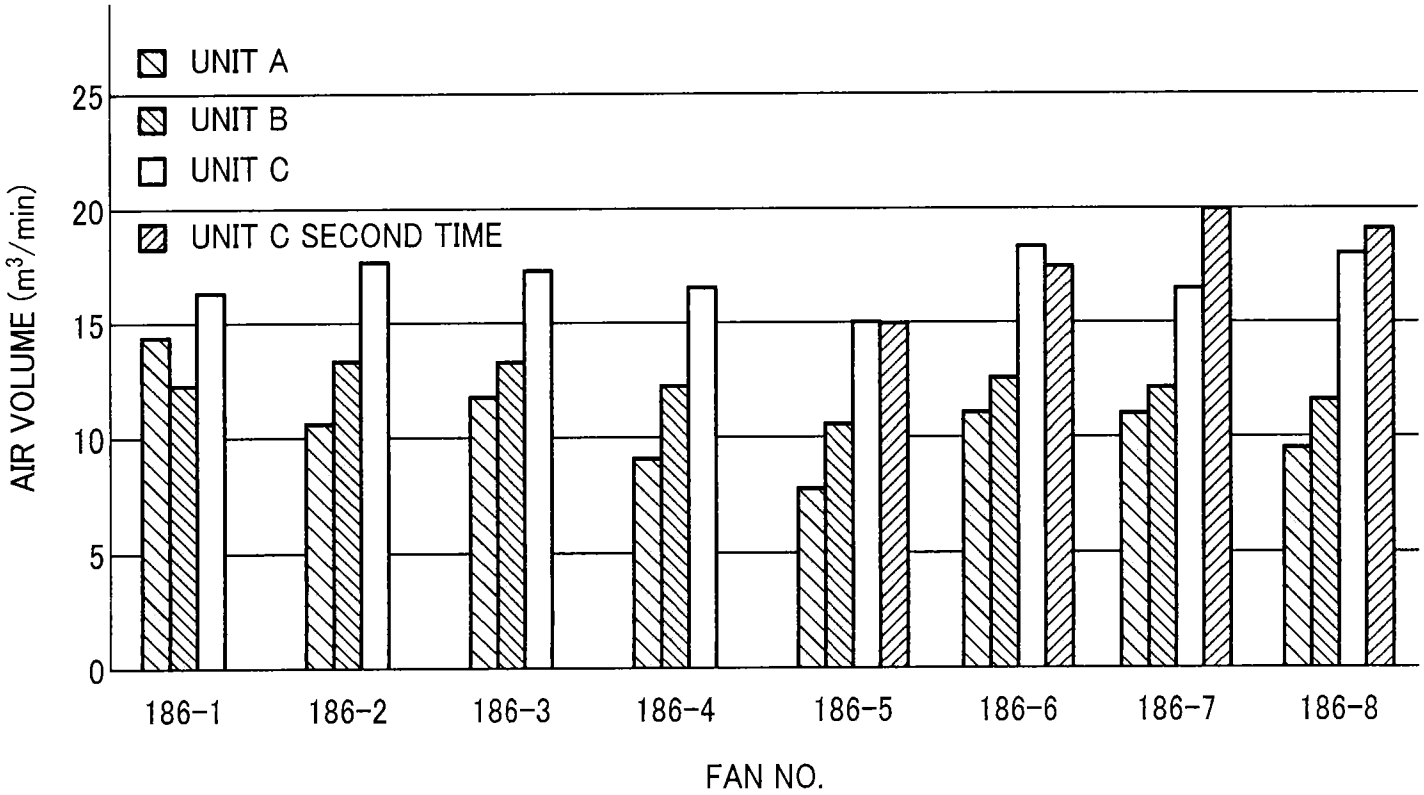
FIG. 13 is a graph showing total air volumes obtained when each air blowing fan of the fan unit is operated one by one.

FIG. 13 is a graph showing total air volumes obtained when each of the eight air blowing fans 186 of the fan unit 185 is operated one by one. A horizontal axis of the graph of FIG. 13 represents the fan numbers and a vertical axis of the graph represents the air amount (in a unit of $m^3$/min.) generated by the respective fans. The fan numbers correspond to those of the respective air blowing fans 186 illustrated in FIG. 11B. It is to be noted that the eight air blowing fans 186 are set to an identical rotation speed.

The air amounts are measured using an air velocity meter (Climomaster model manufactured by Kanomax Japan Inc.). Then, nine (9) measuring points are provided on the second outer opening 197*a* where the air amounts are measured by the air velocity meter. After the measurement of the respective air amounts of the air blowing fans 186 is completed, respective average values of the air amounts measured at the nine measuring points are indicated in the vertical axis of the graph of FIG. 13.

Figure 14:
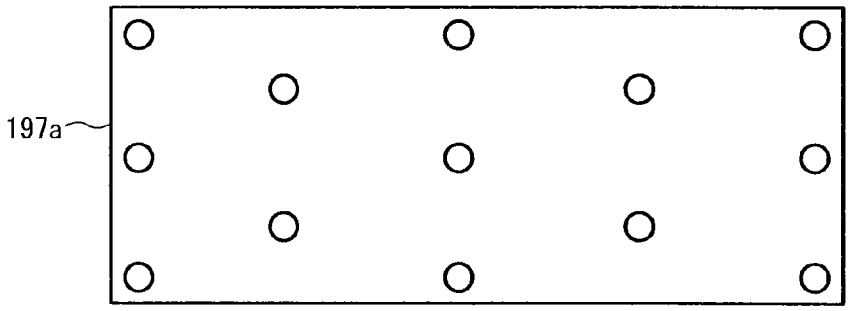
FIG. 14 is a layout of measuring points for measuring the total air volume at a second outer opening.

FIG. 14 is a layout of the measuring points when the total air volumes at the second outer opening 197*a*. The measuring points are illustrated as a circle "○" in FIG. 14. When a front/back direction of the image forming apparatus 300 corresponds to a vertical direction of FIG. 14 and a width direction of the image forming apparatus 300 corresponds to a left/right direction, three first groups, each having three measuring points in the front/back direction of the image forming apparatus 300, are located in the width direction of the image forming apparatus 300. One of the three first groups of the measuring points is located at the center in the width direction of the image forming apparatus 300 and the other two are located at equal positions split to the left and right in the width direction of the image forming apparatus 300 from the first group at the center. In addition, two second groups, each having two measuring point in the front/back direction of the image forming apparatus 300, are located in the width direction of the image forming apparatus 300. Each of the two second groups is located between the adjacent two of the three first groups of the measuring points.

The air amounts were measured using three image forming apparatuses 300. Each of the image forming apparatuses 300 were indicated as Unit A, Unit B, and Unit C in FIG. 13.

First, as shown in the graph of FIG. 13, the air amount of the air blowing fan 186-5 is smaller than the other air blowing fans 186. It is because the air blowing fan 186-5 is located far from both the first passage opening part 192*a* and the second passage opening part 192*b*.

Second, the measurement of air amount of the air blowing fans 186 has proved that the air blowing fans 186-2, 186-3, 186-6, and 186-7 disposed toward the center operate more efficient than the air blowing fans 186-1, 186-4, 186-5, and 186-8 disposed at corners. This result relates to air flow in the outer duct 195. Specifically, a part of the outer duct 195 is located in the vicinity of an exhaust port of the air blowing fans 186-1, 186-4, 186-5, and 186-8 disposed at corners. By contrast, the air blowing fans 186-2, 186-3, 186-6, and 186-7 disposed toward the center has no hindrance in the vicinity of an exhaust port thereof. Therefore, the amounts of air flow of the air blowing fans 186-2, 186-3, 186-6, and 186-7 increase.

Consequently, it is obvious that the air blowing fans 186-2, 186-3, 186-6, and 186-7 disposed toward the center can provide more efficient operations than the air blowing fans 186-1, 186-4, 186-5, and 186-8.

It is to be noted that the present embodiment has shown the above-described description as an example to adjust the cooling capacity of the cooling device 100. The adjustment of the cooling capacity of the cooling device 100 depends on combinations of ON/OFF of rotation of the multiple air blowing fans 186 in the fan unit 185 according to the type of the sheet P used for image formation in the image forming apparatus 300. However, the configuration of the inner flow paths 181*a* of the radiator 181 and the configuration of the air blowing fans 186 to turn on to rotate are applicable not only when the multiple air blowing fans 186 are provided with respect to the single radiator 181 but also when the cooling capacity of the cooling device 100 is adjusted depending on different conditions.

Further, the above-described example has shown the configuration in which the air taken into the inner duct 191 from the first passage opening part 192*a* and the second passage opening part 192*b*. The first passage opening part 192*a* is disposed on the upper part of the air blow opening 193 to which the radiator 181 is attached, and the second passage opening part 192*b* is arranged on the sidewall on the left side of the inner duct 191. However, the configuration of the inner flow paths 181*a* of the radiator 181 and the air blowing fans 186 to turn on to rotate when the multiple air blowing fans 186 are provided with respect to the single radiator 181 can be changed accordingly due to an air flow resistance in intake and exhaust directions of each of the air blowing fans 186.

Figure 15:
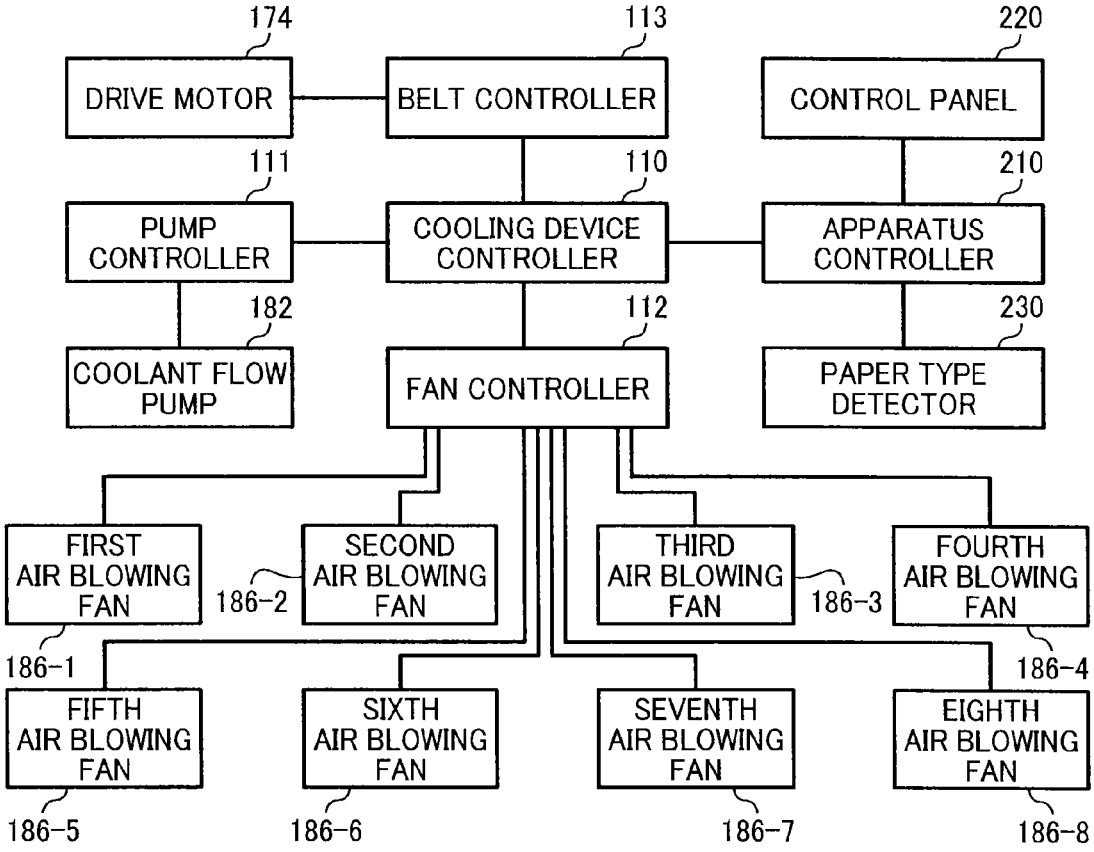
FIG. 15 is a block diagram illustrating a cooling device controller included in the cooling device.

Here, a description is given of the cooling device controller 110 that controls each part of the cooling device 100 according to the present embodiment. FIG. 15 is a block diagram illustrating the cooling device controller 110 included in the cooling device 100.

As illustrated in FIG. 15, the cooling device controller 110 provided in the cooling device 100 according to the present embodiment mutually communicates with the apparatus controller 210 provided in the apparatus body 200. Information about the type of the sheet P inputted via the control panel 220 can be mutually communicated and shared between the apparatus controller 210 and the cooling device controller 110.

The cooling device controller 110 includes a belt controller 113, a pump controller 111, and a fan controller 112. The belt controller 113 drives the drive motor 174. The pump controller 111 drives the coolant feed pump 182. The fan controller 112 drives the eight air blowing fans 186 individually.

The cooling device controller 110 includes a CPU (central processing unit), a RAM (random access memory), a ROM (read-only memory) and so forth. The RAM stores drive information of each drive member based on various conditions obtained via a test. The CPU calculates based on programs stored in the ROM and controls the driving of each drive member via a corresponding controller.

It is to be noted that the cooling device 100 according to the present embodiment provides the cooling device controller 110 different from the apparatus controller 210 in the apparatus body 200. However, the cooling device controller 110 can be provided as a module in the apparatus controller 210.

Here, the cooling device 100 according to the present embodiment changes the cooling capacity of the cooling device 100 according to the type of the sheet P based on the information input via the control panel 220 that functions as a user operation panel.

By changing the cooling capacity of the cooling device 100 as described above, when setting the sheets P to the two sheet trays 31 provided in the image forming apparatus 300, for example, the cooling capacity can vary according to the type of the sheet P by using information inputted by a user about the type of the sheet P. Therefore, the cooling capacity of the control device 100 can vary efficiently according to the type of the sheet P used for image formation in the image forming apparatus 300.

However, the present embodiment is not limited to the configuration described above. For example, a paper type detector 230 is provided in the apparatus body 200 or in the cooling device 100 so as to detect the types of the sheet P. Based on detection results obtained by the paper type detector 230, the cooling capacity of the cooling device 100 can vary according to the type of the sheet P.

Different from the configuration to change the cooling capacity of the cooling device 100 based on information inputted by the user via the control panel 220, the variation of the cooling capacity of the cooling device 100 can eliminate operation errors caused by the user when the user inputs the information about the type of the sheet P. As a result, the cooling capacity of the cooling device 100 can vary according to the type of the sheet P for image formation in the image forming apparatus 300 efficiently and reliably.

Further, the cooling device 100 according to the present embodiment has shown an example that the cooling device controller 110 controls ON/OFF of rotation of the air blowing fans 186 individually based on an ambient temperature and a print mode condition (information) in addition to the information about the paper type and basis weight which are information related to the type of the sheet P. However, the cooling device 100 is not limited to the above-described configuration. For example, the cooling device 100 may be controlled based on combinations of ON/OFF of rotation of the respective air blowing fans 186 under a condition of the number of prints per job (a series of image forming operations) in consideration of time change of a heat release amount of heat from the fixing unit 15 as an additional condition to the above-described conditions.

It is to be noted that the image forming apparatus 300 can achieve the same effect as the cooling device 100 by providing the cooling device 100 as described above.

In a case in which any of the air blowing fans 186 is turned off, the test results shown in the graph of FIG. 13 indicate which air blowing fan 186 is rotated to obtain the total air amount more efficiently.

Figure 16A:
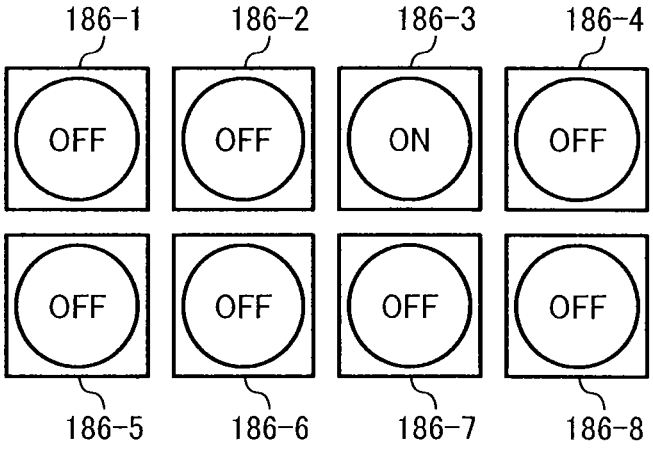
FIGS. 16A through 16C are diagrams illustrating examples of efficient positions of the air blowing fans when one, two, or four of the air blowing fans are rotated.
Figure 16B:
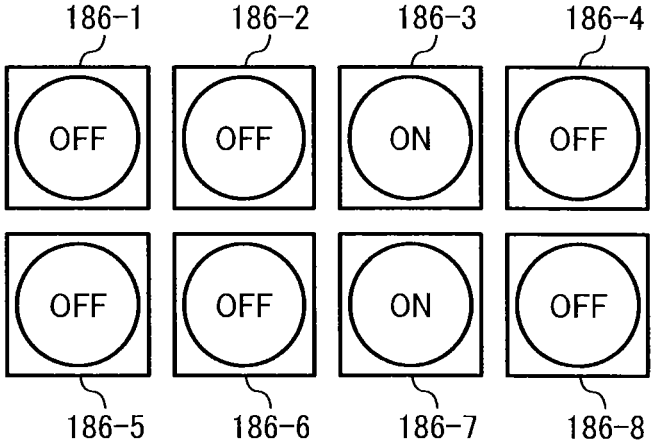
Figure 16C:
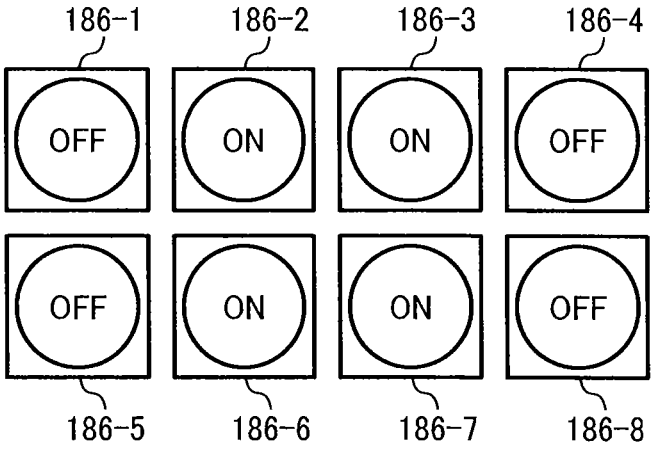

FIGS. 16A through 16C are diagrams illustrating examples of efficient positions of the air blowing fans 186 when one, two, or four of the air blowing fans 186 are rotated. Specifically, FIG. 16A is an example when one air blowing fan 186 is rotated, FIG. 16B is an example when two air blowing fans 186 are rotated, and FIG. 16C is an example when four air blowing fans 186 are rotated.

When four air blowing fans 186 are turned off and the other four air blowing fans 186 are turned on, according to the test results shown in the graph of FIG. 13, the total air amount can be obtained more efficiently by turning on the air blowing fans 186-2, 186-3, 186-6, and 186-7 toward the center and turning off the air blowing fans 186-1, 186-4, 186-5, and 186-8 disposed at the corners, as illustrated in FIG. 16C.

Further, the total air amount can be adjusted by combining respective rotations and ON/OFF of the eight air blowing fans 186.

Further, the quantities of the air blowing fans 186 to be rotated are shown in Table 2. However, the positions of the air blowing fans 186 to be rotated may be selected from any of the examples illustrated in FIGS. 16A, 16B, and 16C based on the test results shown in the graph of FIG. 13.

For example, when one of the air blowing fans 186 is rotated, the air blowing fan 186-3 as illustrated in FIG. 16A or the air blowing fan 186-2 can operate more efficiently because both the air blowing fans 186-2 and 186-3 are proved to exhaust a large air amount in the graph of FIG. 13.

When two of the air blowing fans 186 are rotated, the air blowing fans 186-3 and 186-7 as illustrated in FIG. 16B can operate more efficiently because both the air blowing fans 186-3 and 186-7 are proved to exhaust a large air amount in the graph of FIG. 13. Other different combinations of the air blowing fans 186 producing a large air amount are also applicable. For example, a combination of the air blowing fans 186-2 and 186-6, a combination of the air blowing fans 186-2 and 186-7, or a combination of the air blowing fans 186-3 and 186-6 can achieve the same efficiency.

Further, when four of the air blowing fans 186 are rotated, the air blowing fans 186-2, 186-3, 186-6, and 186-7 as illustrated in FIG. 16C can operate more efficiently because the air blowing fans 186-2, 186-3, 186-6, and 186-7 are proved to exhaust a large air amount in the graph of FIG. 13.

Further, there are four levels of the basis weight and four quantities (one, two, four, and eight) of the air blowing fans 186 to be rotated (turned on) in Table 2. However, the levels of the basis weight, the quantities of the air blowing fans 186 to be rotated, and the other items in Table 2 are not limited thereto. For example, the levels of the basis weight can be three or less or can be five or more. Further, the quantities of the air blowing fans 186 to be rotated (turned on) can be five or more or can be two (one unit or eight units) or three (one unit, four units, or eight units). A reduction in the items can make the control of the air blowing fans 186 easier. By contrast, an increase in items can achieve a more detailed control.

Further, in Table 2, the number of the air blowing fans 186 to be rotated (to turn) is set based on the basis weight, ambient temperature, paper type, print mode, and the like. However, the items or parameters are not limited thereto. For example, the number of the air blowing fans 186 to be rotated can be set according to the basis weight as a single item. This can make the control easier.

Further, eight of the air blowing fans 186 are included in the fan unit 185 of the image forming apparatus 300. However, any number can be applied to the number of the air blowing fans 186.

Next, a description is given of another exemplary configuration of the cooling device 100 according to the present embodiment.

The elements or units of the cooling device 100 of this exemplary configuration are similar in structure and functions to the elements or units of the cooling device of the previously described exemplary configuration of the cooling device 100, except that processes of a control method of the air blowing fans 186 in the fan unit 185. The elements or components of the cooling device 100 and the image forming apparatus 300 may be denoted by the same reference numerals as those of the cooling device 100 and the image forming apparatus 300 and the descriptions thereof are omitted or summarized.

Specifically, in order to vary the cooling capacity of the cooling device 100, this exemplary configuration of the cooling device 100 controls respective rotation speeds of the air blowing fans 186 individually while the previously described exemplary configuration of the cooling device 100 provides various combinations of ON/OFF of rotation of the multiple (eight) air blowing fans 186.

Table 3 shows examples of PWM (Pulse Width Modulation) Duties when rotating the entire (eight) air blowing fans 186 at an identical rotation speed.

TABLE 3

| | | | Basis Weight | | | |
|---|---|---|---|---|---|---|
| Ambient Temp. X | Paper Type | Print Mode | Below 100 gsm | 100 gsm-149 gsm | 150 gsm-299 gsm | 300 gsm-400 gsm |
| X < A | Plain | Simplex | 20% | 20% | 40% | 60% |
| | Paper | Duplex | 20% | 20% | 40% | 60% |
| | Coated | Simplex | 20% | 20% | 40% | 60% |
| | Paper | Duplex | 20% | 20% | 40% | 100% |
| A ≤ X < B | Plain | Simplex | 20% | 40% | 40% | 100% |
| | Paper | Duplex | 20% | 40% | 40% | 100% |
| | Coated | Simplex | 20% | 40% | 60% | 100% |
| | Paper | Duplex | 20% | 40% | 60% | 100% |
| B ≤ X | Plain | Simplex | 20% | 40% | 60% | 100% |
| | Paper | Duplex | 20% | 40% | 60% | 100% |
| | Coated | Simplex | 40% | 60% | 100% | 100% |
| | Paper | Duplex | 40% | 60% | 100% | 100% |

As described in Table 2, Table 3 indicates that the ambient temperature is referred to as an "ambient temperature X", a given lower temperature is referred to as a "lower given temperature A", and a given upper temperature is referred to as an "upper given temperature B".

For example, under a condition where the ambient temperature X is below the temperature A (X<A), if the sheet P conveyed for image forming is a coated paper (paper type) having the basis weight of 400 gsm to be printed in the duplex print mode, the entire (eight) air blowing fans 186 are rotated at a full speed (the rated rotation speed) as shown in Table 3.

The entire (eight) air blowing fans 186 are rotated because the sheet P is a coated paper having the basis weight of 400 gsm, requires a large amount of heat for fixing by heat and pressure, and passes the fixing unit 15 two times for duplex printing. Therefore, the amount of heat absorbed from the sheet P by the cooling body 141 of the heat receiver 140 increases. In a case in which a large amount of heat is to be absorbed from the sheet P, the amount of heat to be released in the heat radiating part 180 approaches the maximum amount of releasable heat in the heat radiating part 180. For those reasons, the entire (eight) air blowing fans 186 are to be operated at the full speed, so as to increase the heat dissipation effect of the radiator 181. Specifically, the entire air blowing fans 186 are rotated at a 100% PWM Duty that rotates the entire air blowing fans 186 at the full speed.

By contrast, even under the condition in which the ambient temperature X is below the temperature A, if the sheet P is a plain paper having the basis weight of 70 gsm to be printed in the simplex print mode, one of the eight air blowing fans 186 is rotated at the rated rotation speed as shown in Table 2.

The selected one of the air blowing fans 186 is rotated because the sheet P is a plain paper having the basis weight of less than 100 gsm, requires a small amount of heat for fixing by heat and pressure, and passes the fixing unit 15 one time for simplex printing. Therefore, the amount of heat absorbed from the sheet P by the cooling body 141 of the heat receiver 140 decreases. In a case in which a small amount of heat is to be absorbed from the sheet P, the amount of heat to be released in the heat radiating part 180 is also reduced. For those reasons, the eight air blowing fans 186 is to be operated at a 20% PWM Duty that rotates each of the air blowing fans 186, so as to obtain the heat dissipation effect of the radiator 181.

As described above, by adjusting the rotation speed of the air blowing fans 186 according to the type of the sheet P, the cooling capacity of the cooling device 100 can be adjusted. Consequently, a reduction in power consumption during image formation, a decrease in noise, and other effects can be achieved.

Same as the cooling device 100 according to the previously described embodiment, the cooling device 100 according to this embodiment can control the eight air blowing fans 186 individually. However, the present invention is not limited to the configuration to control the eight air blowing fans 186 at the same rotation speed.

For example, the heat dissipation effect by the radiator 181 can be achieved by combining four of the air blowing fans 186 rotating at the full speed and the other four of the air blowing fans 186 rotating at the half speed.

Further, the rotation speed of each air blowing fan 186 may be adjusted by stopping rotation of any of the air blowing fans 186 or by turning off any of the air blowing fans 186.

Due to different air amounts shown in the graph of FIG. 13, even if the quantities of the air blowing fans 186 are turned on, more detailed adjustment of the total air amount can be performed by setting the combination of the air blowing fans 186 to be rotated.

As described above, by individually controlling the rotation speed of each air blowing fan 186, the cooling capacity of the cooling device 100 can vary more specifically. Consequently, a reduction in power consumption during image formation, a decrease in noise, and other effects can be more enhanced.

Further, eight of the air blowing fans 186 are included in the fan unit 185 of the image forming apparatus 300. However, any number can be applied to the number of the air blowing fans 186.

Further, the above-described exemplary configurations are applied to the cooling device 100 in which the sheet P is cooled after the fixing operation by application of heat and pressure in the fixing unit 15 of the image forming apparatus 300. However, the present invention is not limited to the above-described configurations. For example, a cooling device that cools the development units 3 and/or the optical writing units 2 is also applicable to the present invention. In other words, any liquid type cooling device used in an image forming apparatus can be applied to the present invention without limiting configurations of cooling targets and a heat receiver (e.g., the heat receiver 140).

Further, the cooling device 100 according to the above-described embodiment(s) is included in the apparatus body 200 of the image forming apparatus 300. However, the configuration of the cooling device applicable to the present invention is not limited thereto. For example, the present invention can be applied to an image forming apparatus that includes an image forming unit and a cooling device disposed in separate bodies.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A liquid type cooling device comprising:

a radiator to radiate heat of a coolant that passes therethrough; and multiple air blowing fans to blow air to the radiator, each of the multiple air blowing fans operates individually and varies a cooling capacity of the liquid type cooling device, and a number of the multiple air blowing fans that are activated varies according to a type of a recording medium on which an image is formed.

2. The cooling device according to claim 1, wherein the cooling capacity varies according to the type of the recording medium based on a combination of ON/OFF of rotation of the multiple air blowing fans.

3. The cooling device according to claim 1, wherein the cooling capacity varies according to the type of the recording medium based on an adjustment of a rotation speed of the multiple air blowing fans.

4. The cooling device according to claim 1, wherein the multiple air blowing fans includes a first air blowing fan, a second air blowing fan, and a third air blowing fan, the first air blowing fan is disposed between the second air blowing fan and the third air blowing fan in a recording medium conveyance direction.

5. The cooling device according to claim 4, wherein the first air blowing fan turns on to rotate regardless of the type of the recording medium.

6. The cooling device according to claim 1, wherein the radiator includes multiple liquid conduits through which the coolant flows, wherein the multiple liquid conduits are provided in an alignment direction of the multiple air blowing fans.

7. An image forming apparatus comprising:

a fixing device to fix an image formed on a recording medium to the recording medium by application of heat; and the liquid cooling device according to claim 1 to cool the recording medium.

8. The image forming apparatus according to claim 7, further comprising a control panel via which information is inputted, wherein the cooling capacity varies according to the type of the recording medium by using information inputted via the control panel.

9. The image forming apparatus according to claim 7, further comprising a detector to detect the type of the recording medium, wherein the cooling capacity varies according to the type of the recording medium detected by the detector.

10. The cooling device according to claim 1, wherein the multiple air blowing fans blow air to a same radiator.

11. The cooling device according to claim 1, wherein the number of the multiple air blowing fans that are activated varies according to a thickness of the recording medium on which an image is formed.

12. The cooling device according to claim 1, wherein a pulse width modulation duty of the multiple air blowing fans varies according to an ambient temperature.

13. A liquid type cooling device comprising:

a radiator to radiate heat of a coolant that passes therethrough; and multiple air blowing fans to blow air to the radiator, the multiple air blowing fans including a first air blowing fan, a second air blowing fan, and a third air blowing fan, the first air blowing fan is disposed between the second air blowing fan and the third air blowing fan in a recording medium conveyance direction, and multiple sets of the first air blowing fan, the second air blowing fan, and the third air blowing fan are provided in a transverse direction to the recording medium conveyance direction.

14. An image forming apparatus comprising:

a fixing device to fix an image formed on a recording medium to the recording medium by application of heat; and the liquid cooling device according to claim 13 to cool the recording medium.

15. The cooling device according to claim 13, wherein the multiple sets include at least two of the first air blowing fan, at least two of the second air blowing fan, and at least two of the third air blowing fan in the transverse direction to the recording medium conveyance direction.

16. The cooling device according to claim 13, wherein the radiator includes multiple liquid conduits through which the coolant flows, wherein the multiple liquid conduits face the multiple air blowing fans.

17. A liquid type cooling device comprising:

a radiator to radiate heat of a coolant that passes therethrough; and multiple air blowing fans disposed facing the radiator to blow air to the radiator;

a duct through which air passes, the duct including a first duct to intake outside air to a first opening part and a second duct to pass air exhausted from the multiple air blowing fans; and a partition to separate the first duct and the second duct.

18. The cooling device according to claim 17, wherein the radiator includes a second opening part to intake the outside air and that is disposed at a different position from the first opening part, wherein the second opening part is disposed downstream from the first opening part in a liquid flow direction of multiple liquid conduits of the radiator.

19. The cooling device according to claim 18, wherein the radiator includes multiple air flow spaces through which air passes, wherein the duct includes first air flow paths to guide air therethrough from the first opening part to the second duct via the multiple air flow spaces of the radiator and second air flow paths to guide air therethrough from the second opening part to the second duct via the multiple air flow spaces of the radiator.

20. An image forming apparatus comprising:

a fixing device to fix an image formed on a recording medium to the recording medium by application of heat; and the liquid cooling device according to claim 17 to cool the recording medium.

21. A liquid type cooling device comprising:

a radiator to radiate heat of a coolant that passes therethrough;

multiple air blowing fans disposed facing the radiator to blow air to the radiator; and a duct through which air passes, the duct including a first opening part to intake outside air from an opposing direction to a recording medium conveyance direction and a second opening part to exhaust air that has passed through the multiple air blowing fans.

22. The cooling device according to claim 21, wherein the second opening part exhausts the air that has passed through the multiple air blowing fans toward a downward side of the cooling device.

23. An image forming apparatus comprising:

a fixing device to fix an image formed on a recording medium to the recording medium by application of heat; and the liquid cooling device according to claim 21 to cool the recording medium.

* * * * *